US010452014B2

(12) United States Patent
Nemoto

(10) Patent No.: US 10,452,014 B2
(45) Date of Patent: Oct. 22, 2019

(54) IMAGE FORMING APPARATUS CAPABLE OF SWITCHING COLOR MODE

(71) Applicant: CANON KABUSHIKI KAISHA, Tokyo (JP)

(72) Inventor: Yusuke Nemoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 224 days.

(21) Appl. No.: 15/602,496

(22) Filed: May 23, 2017

(65) Prior Publication Data

US 2017/0351208 A1 Dec. 7, 2017

(30) Foreign Application Priority Data

Jun. 7, 2016 (JP) ..... 2016-113800

(51) Int. Cl.
*G03G 15/00* (2006.01)
*G03G 15/01* (2006.01)

(52) U.S. Cl.
CPC ..... *G03G 15/50* (2013.01); *G03G 15/01* (2013.01); *G03G 15/0136* (2013.01)

(58) Field of Classification Search
CPC .... G03G 15/01; G03G 15/50; G03G 15/0136; G03G 15/0189; G03G 2215/00126
See application file for complete search history.

(56) References Cited

U.S. PATENT DOCUMENTS 7,430,382 B2 * 9/2008 Sugaya ..... G03G 15/0194 399/299

FOREIGN PATENT DOCUMENTS

JP 2003-262999 A 9/2003

* cited by examiner

*Primary Examiner* — Erika J Villaluna
(74) *Attorney, Agent, or Firm* — Venable LLP

(57) ABSTRACT

If an inputted job requires switching from a single-color mode to a multicolor mode, an image forming apparatus switches from the single-color mode to the multicolor mode during a relatively long processing waiting time out of processing waiting times between preceding pages and succeeding pages, before a page in the job for forming a multicolor image.

23 Claims, 19 Drawing Sheets

IMAGE FORMING APPARATUS CAPABLE OF SWITCHING COLOR MODE

BACKGROUND OF THE INVENTION

Field of the Invention

The present invention relates to an image forming apparatus.

Description of the Related Art

An electrophotographic image forming apparatus superimposes toner images each of a different color to form a multicolor image, or uses only black toner to form a single-color image. In such an image forming apparatus, a photosensitive member is disposed for each color of toner. The photosensitive members suffer wear because each photosensitive member is in contact with the intermediate transfer belt. To reduce wear of the photosensitive member, in the single-color mode, only a photosensitive member that carries a black toner image is in contact with the intermediate transfer belt, and the photosensitive members that carry toner images of other colors are separated from the intermediate transfer belt. In the multicolor mode, all of the photosensitive members are in contact with the intermediate transfer belt. Making photosensitive members be in contact with or separated from the intermediate transfer belt requires a certain amount of time. In particular, in an image forming job that mixes multicolor images and single-color images, if separation and contact are frequently performed, the productivity of image formation decreases.

By Japanese Patent Laid-Open No. 2003-262999, when printing in a full color mode, continuing in the full color mode when a consecutive number of succeeding monochrome images is less than a threshold, and switching to a monochrome mode when it is greater than or equal to the threshold is proposed. Because of this, productivity and efficiency at a time of printing that mixes full color and monochrome are increased.

However, in Japanese Patent Laid-Open No. 2003-262999, the full color mode is switched to the monochrome mode or the monochrome mode is switched to the full color mode irrespective of the length of a sheet interval. Therefore, when seen from the entirety of an image forming job, there are cases in which productivity decreases. Note that a sheet interval is the distance present between a preceding page and a succeeding page in a conveyance path, and a processing waiting time in accordance with this distance.

SUMMARY OF THE INVENTION

Accordingly, the present invention reduces a decrease of productivity in a job that mixes single-color images and multicolor images.

The present invention may provide an image forming apparatus comprising the following elements. A first forming unit is configured to form an image by using toner of a first color. A second forming unit is configured to form an image by using toner of a second color. An intermediate transfer member onto which at least the image from the first forming unit is transferred is provided. A contact and separation unit has a multicolor mode in which the contact and separation unit causes the intermediate transfer member to be in contact with both of the first forming unit and the second forming unit, and a single-color mode in which the contact and separation unit causes the intermediate transfer member to be separated from the second forming unit while causing the intermediate transfer member to stay in contact with the first forming unit. A controller is configured to control the first forming unit and the second forming unit to form a multicolor image that superimposes an image using the toner of the first color and an image using the toner of the second color, or form a single-color image that uses the toner of the first color and does not use the toner of the second color. The controller is further configured to, if switching from the single-color mode to the multicolor mode is necessary in an inputted job, switch from the single-color mode to the multicolor mode during a relatively long processing waiting time out of processing waiting times between preceding pages and succeeding pages, before a page in the job for forming the multicolor image.

Further features of the present invention will become apparent from the following description of exemplary embodiments (with reference to the attached drawings).

DESCRIPTION OF THE EMBODIMENTS

In embodiments, so that switching of the color mode is performed in a relatively long sheet interval, a timing of switching from the multicolor mode (full color mode) to the single-color mode (monochrome mode) is delayed (postponed switching), and a timing of switching from the single-color mode to the multicolor mode is performed ahead-of-schedule (ahead-of-schedule switching). For example, if a relatively long processing waiting time (sheet interval) is present around a time at which switching of the color mode should be performed, switching of the color mode is made ahead-of-schedule or postponed. Because of this, the productivity in an image forming job that mixes single-color images and multicolor images improves. For example, when a job in which a plurality of single-color images are to be formed before a multicolor image is received, switching from the single-color mode to the multicolor mode is performed in a relatively long sheet interval out of a number of sheet intervals present between the plurality of single-color images. This is referred to as ahead-of-schedule switching of the color mode below. In addition, when a job in which a plurality of single-color images are to be formed after a multicolor image is received, switching from the multicolor mode to the single-color mode is performed in a relatively long sheet interval out of a number of sheet intervals present between the plurality of single-color images. This is referred to as postponed switching of the color mode below.

<Basic Configuration of Image Forming Apparatus>

Figure 1:
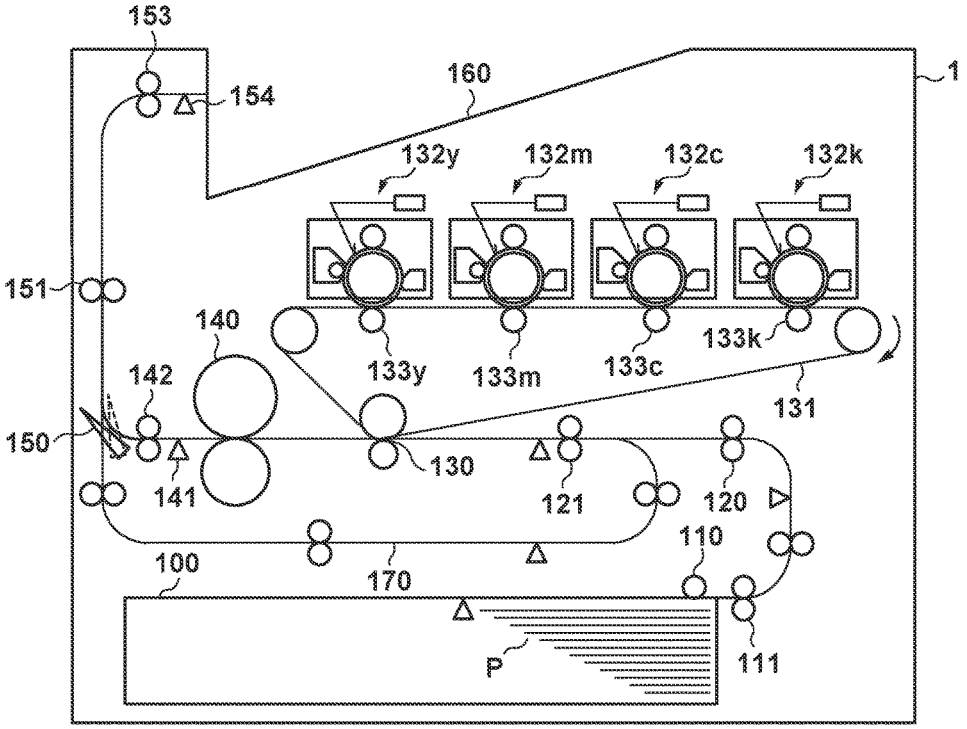
FIG. 1 is a cross-sectional view illustrating an image forming apparatus.

FIG. 1 is used to give an explanation of a basic configuration of an image forming apparatus 1 in embodiments. The image forming apparatus 1 may be commercialized as a printing apparatus, a printer, a copying machine, a multifunction peripheral, or a facsimile machine. The image forming apparatus 1 forms a multicolor image by using toner of respectively different colors, or forms a single-color image by using toner of a single color. A multicolor image is an image formed by using toner of two or more colors, and may also include a full color image. An image forming unit 132*y* is a yellow station for forming a yellow image by using yellow toner. An image forming unit 132*m* is a magenta station for forming a magenta image by using magenta toner. An image forming unit 132*c* is a cyan station for forming a cyan image by using cyan toner. An image forming unit 132*k* is a black station for forming a black image by using black toner. Note that the characters ymck added to the end of reference numerals indicates the color of the toner. In the following explanation, the characters ymck may be omitted. An intermediate transfer belt 131 is an intermediate transfer member on which toner images formed by image forming units 132 are transferred. A multicolor image is formed by each toner image from the image forming unit 132*y* through the image forming unit 132*k* being transferred so as to be superimposed. The toner image is conveyed to a secondary transfer unit 130 by the intermediate transfer belt 131 rotating. The secondary transfer unit 130 transfers the toner image carried by the intermediate transfer belt 131 to a sheet P. The sheet P may be referred to as a recording material, a recording medium, a sheet, a transfer material, or a transfer sheet.

A sheet feed cassette 100 is an accommodation unit for accommodating a plurality of the sheets P. A pickup roller 110 picks up a sheet P, and passes it to a feed/retard roller 111. The feed/retard roller 111 separates a sheet P position topmost out of a plurality of the sheets P, which have been fed overlappingly, from other sheets P, and conveys it to a pre-registration roller 120. The pre-registration roller 120 is a conveyance roller for conveying the sheet P to a registration roller 121. The registration roller 121 is a conveyance roller that conveys the sheet P so that a timing at which the toner image reaches the secondary transfer unit 130 and a timing at which the sheet P reaches the secondary transfer unit 130 match.

A fixing apparatus 140 applies heat and pressure to the sheet P conveyed from the secondary transfer unit 130 to fix the toner image to the sheet P. When a sheet sensor 141 detects a sheet P discharged from the fixing apparatus 140, a branch flapper 150 moves to a position illustrated by solid lines. A fixing conveyance roller 142 conveys the sheet P to a vertical path roller 151. The vertical path roller 151 is a conveyance roller for conveying the sheet P to a discharge roller 153. The discharge roller 153 makes a side on which the image is formed face downward, and discharges the sheet P to sheet discharge tray 160.

Double-sided image formation for forming images on both sides of the sheet P may be instructed. In such a case, if a predetermined period from when a sheet sensor 154 detects a leading edge of the sheet P elapses, the discharge roller 153 stops rotating. Here, the branch flapper 150 is switched to the broken line position of FIG. 1. The discharge roller 153 starts reverse rotation, and conveys the sheet P in the reverse direction (a switchback). The branch flapper 150 guides the sheet P to a double-sided conveying unit 170. The double-sided conveying unit 170 conveys the sheet P to the registration roller 121. Here, the second side of the sheet P faces the intermediate transfer belt 131. The registration roller 121 conveys the sheet P to the secondary transfer unit 130, and a toner image is thereby transferred to the second side of the sheet P. The following processing in double-sided image formation (double-sided printing) is similar to that in single-sided image formation (single-sided printing).

<Image Forming Unit>

Figure 2A:
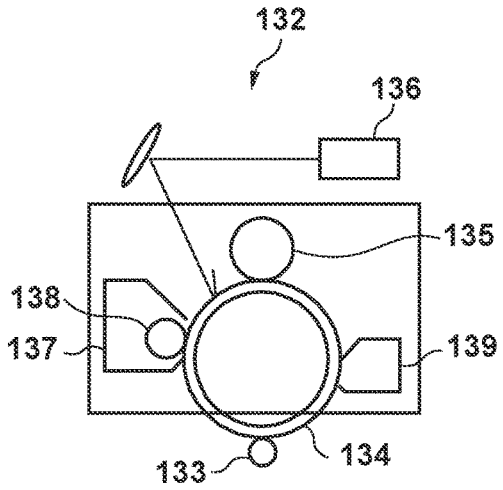
FIGS. 2A and 2B are views illustrating an image forming unit and a contact and separation mechanism.

FIG. 2A illustrates an image forming unit 132. A photosensitive drum 134 is an image carrier that carries an electrostatic latent image or a toner image. A charging roller 135 uniformly charges a surface of the photosensitive drum 134. A laser scanner 136 outputs a laser beam in accordance with inputted image information to expose the surface of the photosensitive drum 134 and form an electrostatic latent image. A developing apparatus 137 accommodates yellow, magenta, cyan, or black toner. A development roller 138 causes toner to adhere to develop an electrostatic latent image and form a toner image. A primary transfer unit 133 transfers the toner image to the intermediate transfer belt 131. A cleaning blade 139 cleans toner left on the surface of the photosensitive drum 134.

<Explanation of Contact/Separation Control of Primary Transfer Unit>

Figure 2B:
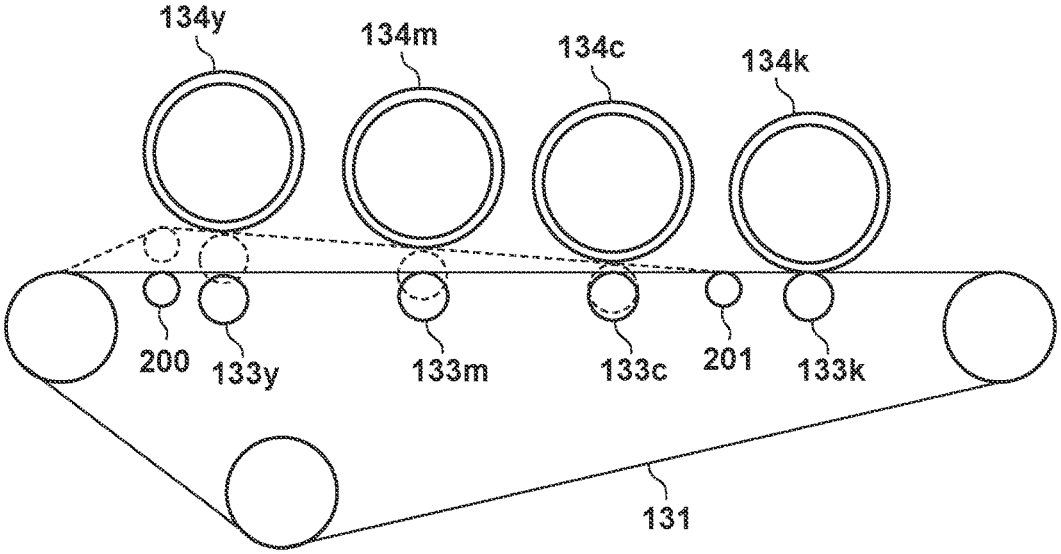

FIG. 2B illustrates a state of contact and a separated state for the primary transfer units 133*y* to 133*k*. Broken lines indicate a state of contact. Solid lines illustrate a separated state. When the multicolor mode is set, a first regulating roller 200 out of the first regulating roller 200 and a second regulating roller 201 that support an inner surface of the intermediate transfer belt 131 is lifted. Because of this, the primary transfer units 133*y*, 133*m*, and 133*c* for yellow, magenta and cyan and not just the primary transfer unit 133*k* for black are in contact with the opposing photosensitive drums 134. In other words, in the multicolor mode, toner images for black, yellow, magenta and cyan can be transferred to the intermediate transfer belt 131.

Meanwhile, when the single-color mode is set, the first regulating roller 200 is lowered. Because of this, the primary transfer units 133*y*, 133*m*, and 133*c* for yellow, magenta and cyan separate from the photosensitive drums 134*y*, 134*m*, and 134*c*, respectively. However, the primary transfer unit 133*k* for black is kept in contact with the photosensitive drum 134*k* for black. In this way, in the single-color mode, it is possible to transfer only a black toner image to the intermediate transfer belt 131.

A reason for switching the primary transfer units 133*y*, 133*m*, and 133*c* for yellow, magenta, and cyan from a state of contact to a separated state in the single-color mode is to reduce wear of the photosensitive drums 134*y*, 134*m*, and 134*c*. Because the photosensitive drums 134*y*, 134*m*, and 134*c* rub the cleaning blades 139*y*, 139*m*, and 139*c* and the intermediate transfer belt 131, the surfaces thereof are scraped. In particular, in a state in which toner is not present on the surface of the photosensitive drum 134, frictional force between the surface of the photosensitive drum 134 and a member in contact therewith becomes great. If the surface of the photosensitive drum 134 is scraped, a phenomenon that it is hard for toner to adhere to the photosensitive drum 134 leading to color omission or fading occurs. When single-color images continue to be formed in the multicolor mode, the life spans of the photosensitive drums 134*y*, 134*m*, and 134*c* become shorter. Accordingly, when forming a single-color image, the life spans of the photosensitive drums 134*y*, 134*m*, and 134*c* are extended by switching from the multicolor mode to the single-color mode.

<Control System>

Figure 3:
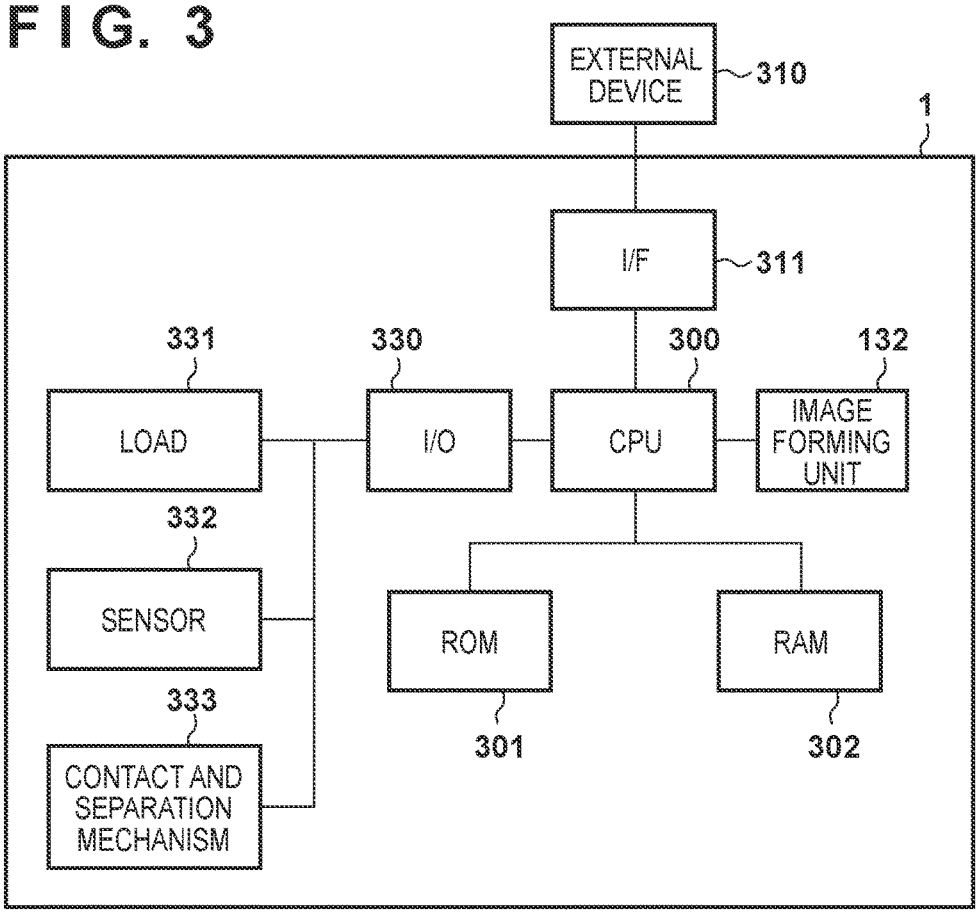
FIG. 3 is a view illustrating a control system.

FIG. 3 illustrates functions of a control system for controlling the image forming apparatus 1. A CPU 300 is a controller (processor) for comprehensively controlling each unit of the image forming apparatus 1. A ROM 301 is a storage device for storing various data and a control program executed by the CPU 300. A RAM 302 is a storage device for storing, for example, job data received from an external device 310 such as a personal computer. An I/F 311 is a communication device for the CPU 300 to communicate with the external device 310.

A load 331 is a solenoid for switching a flapper or a motor for driving various rotating members, such as the registration roller 121. A sensor 332 is a sheet sensor or the like. A contact and separation mechanism 333 is a mechanism for lifting or lowering the first regulating roller 200, and includes, for example, a cam and a gear as well as a motor that drives them, or the like. The contact and separation mechanism 333 may be realized by a solenoid, an actuator, or the like. The CPU 300, the load 331, the sensor 332, and the contact and separation mechanism 333 are connected via an I/O 330, and communicate control signals and detection signals.

<Explanation of Basic Operation of Image Forming Apparatus>

Figure 4:
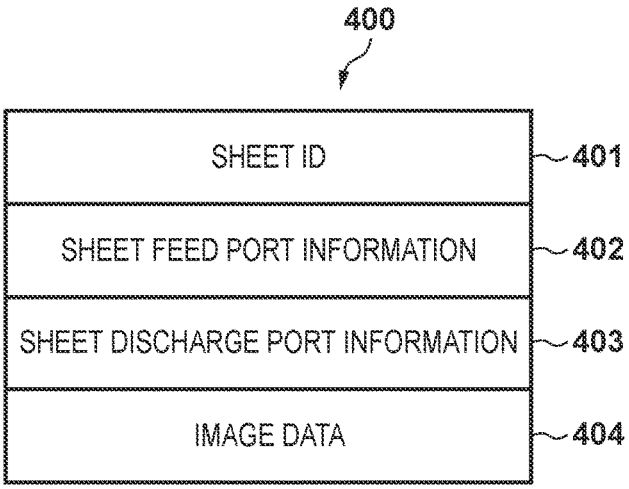
FIG. 4 is a view illustrating print information 400.

Upon receiving print information 400 (job data) from the external device 310, the CPU 300 starts image formation. FIG. 4 illustrates an example of the print information 400. The print information 400 is transmitted for each single page, and stored in the RAM 302. A sheet ID 401 is identification information for identifying each sheet P, and is allocated for each sheet. Sheet feed port information 402 is information that designates a sheet feed port for feeding a sheet P to be used in printing. Set to the sheet feed port information 402 is, for example, information indicating the sheet feed cassette 100 or information indicating the double-sided conveying unit 170. Sheet discharge port information 403 is information that designates a sheet discharge port through which a sheet P to which image formation has completed is discharged. Set to the sheet discharge port information 403 is, for example, information indicating the sheet discharge tray 160 or information indicating the double-sided conveying unit 170. In double-sided printing, the print information 400 for the first side and the print information 400 for the second side are transmitted separately, but each are set with the same sheet ID. In the print information 400 for the first side, information for designating the double-sided conveying unit 170 is stored in the sheet discharge port information 403. In the print information 400 for the second side, information for designating the double-sided conveying unit 170 is stored in the sheet feed port information 402. The CPU 300, in accordance with these pieces of the print information 400, conveys a sheet P for which image formation of the first side has ended to the double-sided conveying unit 170 so as to perform image formation on the second side, and feeds the sheet P from the double-sided conveying unit 170 to the secondary transfer unit 130. Image data 404 included in the print information 400 is image data that indicates an image to be printed to a sheet P.

<Color Mode Switch Timing>

Figure 5:
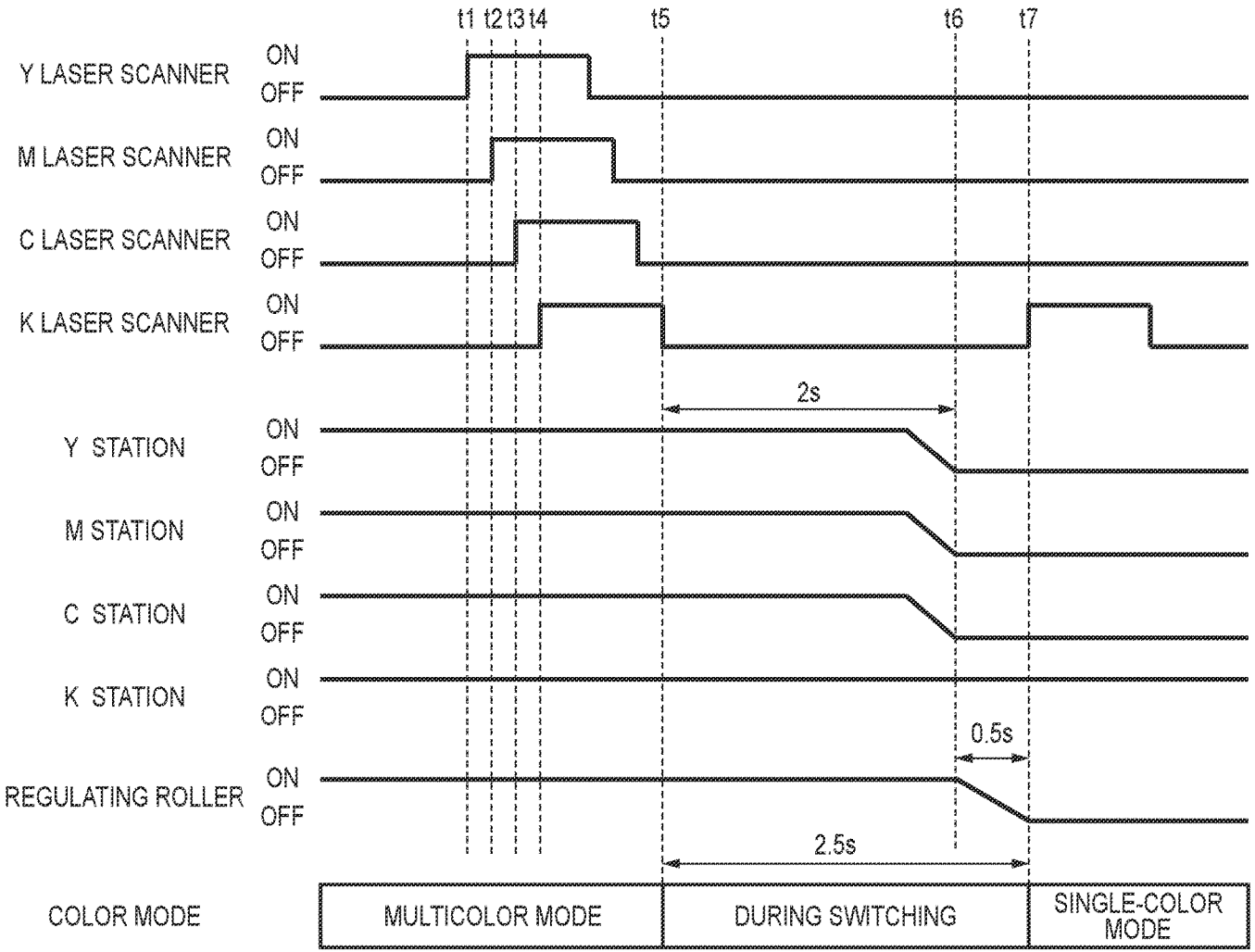
FIG. 5 is a timing chart illustrating switch timing of a color mode.

The image forming apparatus 1 has two types of color modes: a multicolor mode and a single-color mode. FIG. 5 illustrates typical control timings when switching from the multicolor mode to the single-color mode. Here, a case in which a multicolor image is formed on a first sheet P and a single-color image is formed on a second sheet P is illustrated. In FIG. 5, the characters of YMCK indicate yellow, magenta, cyan, and black, respectively. In a period from a time t1 through to a time t5, a multicolor image can be formed because the color mode is set to the multicolor mode. The CPU 300 drives the YMCK laser scanners 136*y* to 136*k* in accordance with the image data 404 to form an image.

At the time t5, the CPU 300 switches the color mode to the single-color mode to form a single-color image based on the print information 400. In a period from the time t5 to a time t6, the CPU 300 causes each of the image forming units 132*y* to 132*c* for YMC to stop. Note that, even if forming of toner images of each color of YMCK ends, the image forming units 132*y* to 132*k* continue to rotate for a fixed period (example: 2 seconds). This is to prepare for subsequent image formation by removing electric potential on the surface of the photosensitive drums 134. In a period from the time t6 to a time t7, the CPU 300 drives the contact and separation mechanism 333 to cause the first regulating roller 200 to lower. Because of this, the image forming units 132*y* to 132*c* for YMC transition from the state of contact to the separated state. A fixed period (example: 0.5 seconds) is necessary for the separation to complete. At the time t7, the CPU 300 drives the laser scanner 136*k* for K, and starts formation of a black image. As illustrated in FIG. 5, a processing time necessary to switch from the multicolor mode to the single-color mode is approximately 2.5 seconds.

Figure 6:
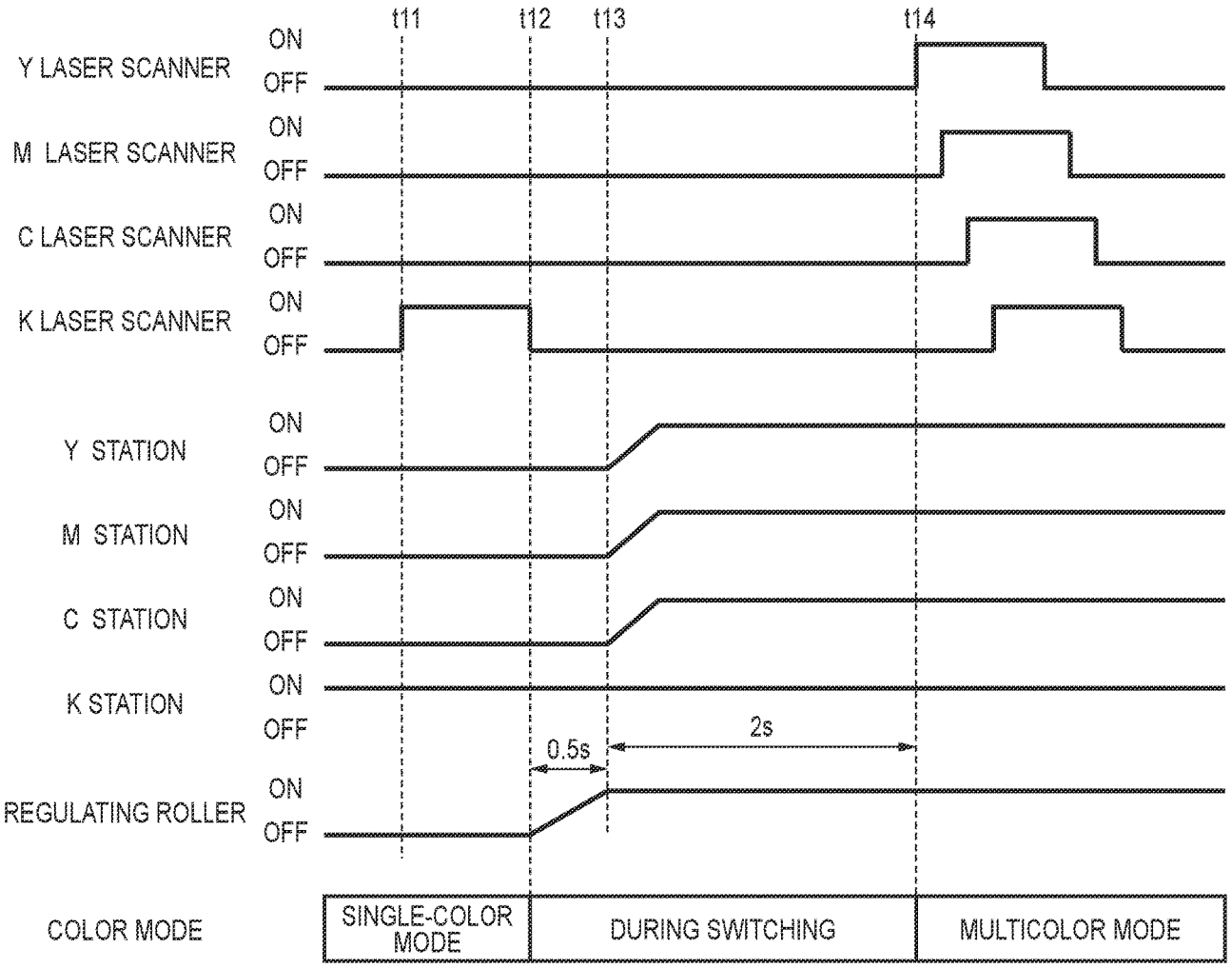
FIG. 6 is a timing chart illustrating switch timing of a color mode.

FIG. 6 illustrates control timings when switching from the single-color mode to the multicolor mode. Here, a case in which a single-color image is formed on a first sheet P and a multicolor image is formed on a second sheet P is illustrated. At a time t11 the CPU 300 drives the laser scanner 136*k* so as to form a single-color image, and forms a toner image for K only on the sheet P. The CPU 300 analyzes the print information 400, and recognizes that the next image is a multicolor image. At a time t12, the CPU 300 drives the contact and separation mechanism 333 to lift the first regulating roller 200 and the second regulating roller 201. Because of this, the image forming units 132*y* to 132*c* for YMC transition from the separated state to the state of contact. At a time t13 the transition to the state of contact completes. A fixed period (example: 0.5 seconds) is necessary to transition from the separated state to the state of contact. At the time t13 the CPU 300 starts driving of the YMC image forming units 132*y* to 132*c*. Note that, in a period from the time t13 to the time t14, the CPU 300 continues to drive the image forming units 132*y* to 132*c*. This is to stabilize the electric potential of the surface of the photosensitive drums 134. From the time t14, the CPU 300 drives the laser scanners 136*y* to 136*k* in an order of YMCK to form a toner image for each color. As illustrated in FIG.

6, a processing time necessary to switch from the single-color mode to the multicolor mode is approximately 2.5 seconds.

In this way, to change the color mode, a processing waiting time that is much longer than a typical sheet interval when consecutively forming images on a plurality of the sheet P is necessary. Accordingly, productivity will decrease if the color mode is frequently switched. In a job that mixes multicolor images and single-color images, it is important to achieve balance between productivity and the life span of the photosensitive drums 134 for YMC. Note that there is a case where the sheet interval indicates a distance between a preceding image and a succeeding image, and a case where it indicates a processing waiting time between a preceding image and a succeeding image. Which of these the sheet interval indicates depends on the context.

<Relation between Sheet Interval and Time to Switch from Single-Color Mode to Multicolor Mode>

Figure 7A:
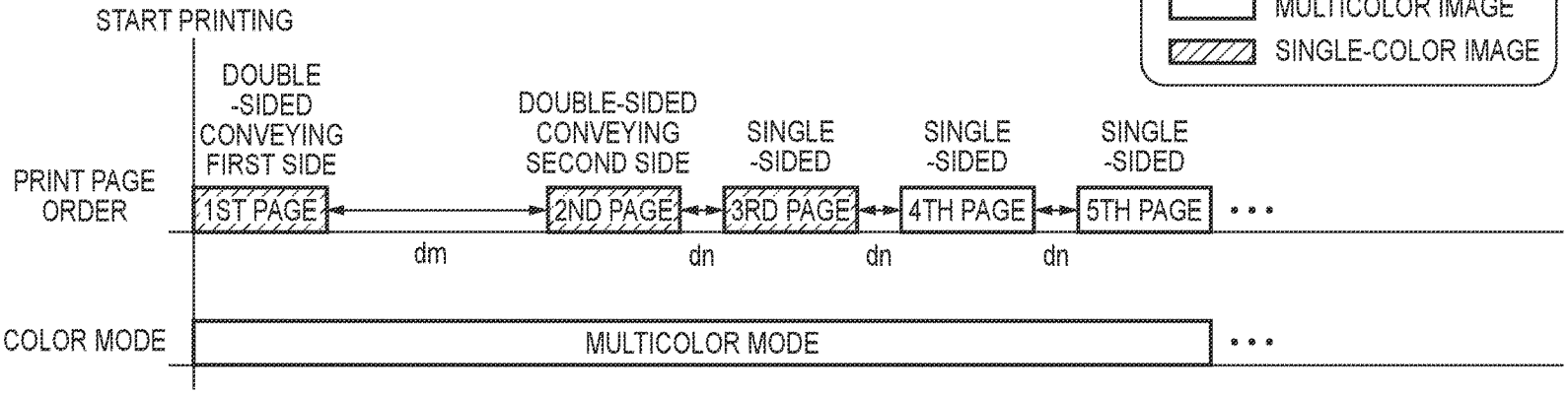
FIGS. 7A, 7B, and 7C are timing charts illustrating jobs that mix single-color images and multicolor images.

FIG. 7A illustrates sheet intervals in a case of forming all pages in the multicolor mode. This case applies to an image forming apparatus that does not have a single-color mode and a contact and separation mechanism, for example. Here, the first page is the first side in a double-sided print, and a single-color image is formed. Here, the second page is the second side in the double-sided print, and a single-color image is formed. The third page is a page on which a single-color image is formed on one side thereof. The fourth and fifth pages are each a page on which a multicolor image is formed on one side. The sheet intervals here indicate sheet intervals in the secondary transfer unit 130.

In the multicolor mode single-color images can be formed in addition to multicolor images. To increase productivity of image formation, a sheet interval that occurs between a preceding page and a succeeding page is set to a minimum sheet interval (a normal sheet interval dn) that can be implemented in the image forming apparatus 1. As explained using FIG. 1, a sheet P for which an image has been formed on a first side in double-sided printing is subject to a switchback by the discharge roller 153 to reverse the front and back, fed into the double-sided conveying unit 170, and further fed into the secondary transfer unit 130. Accordingly, a sheet interval from when a trailing edge of the preceding page (a first side of the sheet P) has passed through the secondary transfer unit 130 until the leading edge of the succeeding page (a second side of the sheet P) has reached the secondary transfer unit 130 is a sheet interval (a processing waiting time) (a double-sided sheet interval dm) that is longer the normal sheet interval dn. In this way, in a job that includes a double-sided print, the sheet interval lengthens by a period for subjecting the sheet P to a switchback. Because the multicolor mode is constantly set in this case, time to switch the color mode does not occur, but wear of the surface of the photosensitive drums 134*y* to 134*c* progresses.

Figure 7B:
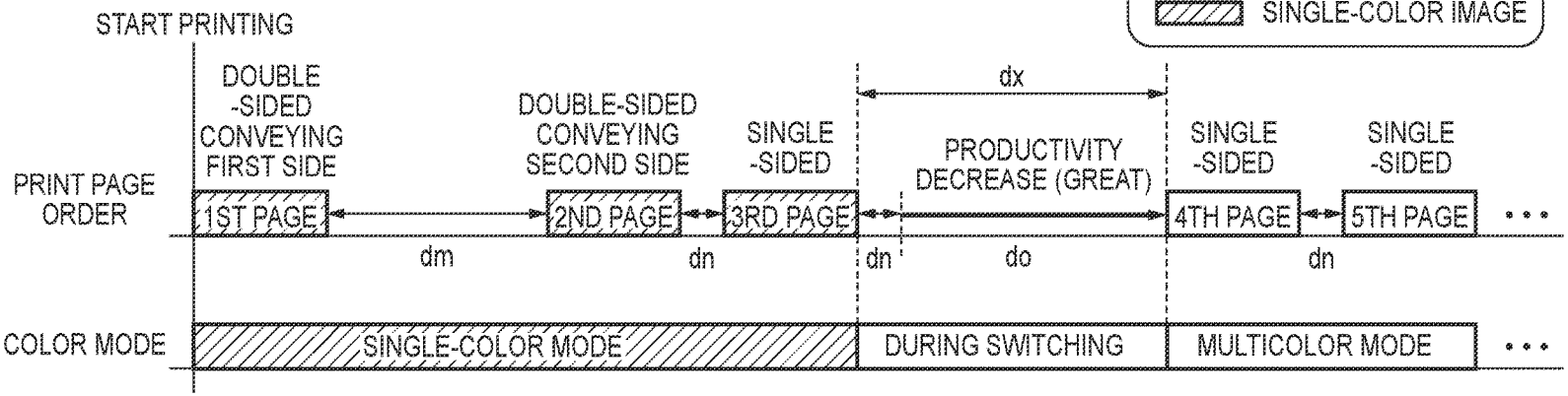

FIG. 7B illustrates sheet intervals in a case of printing single-color images in the single-color mode, and printing multicolor images in the multicolor mode. Print modes applied to the sheets in FIG. 7B are the same as the print modes illustrated in FIG. 7A. The CPU 300 analyzes the print information 400, recognizes that the first page is a page onto which a single-color image is to be formed, and sets the single-color mode. The CPU 300 analyzes the print information 400, recognizes that the second and third pages are also pages for which single-color images are to be formed, and keeps the single-color mode. The CPU 300 analyzes the print information 400, recognizes that the fourth page is a page onto which a multicolor image is to be formed, and switches from the single-color mode to the multicolor mode. As described above, a fixed period is necessary to switch from the single-color mode to the multicolor mode. Accordingly, a sheet interval between the third page and the fourth page in which switching of the color mode is performed is a long sheet interval (a switching sheet interval dx). In other words, productivity decreases by a sheet interval do which is a difference between the switching sheet interval dx and the normal sheet interval dn.

Incidentally, a switchback of the sheet P for a double-sided print is performed in the sheet interval between the first page and the second page. In other words, the sheet interval between the first page and the second page is a double-sided sheet interval dm that is longer than the normal sheet interval dn. The present application's inventor focused on the switching sheet interval dx and the double-sided sheet interval dm. In other words, the inventor realized that if the switching of the color mode is performed ahead-of-schedule in the double-sided sheet interval dm, a decrease of productivity will be reduced. In other words, it is possible to shorten a total of the sheet intervals of the job overall, and a decrease of productivity is reduced.

Figure 7C:
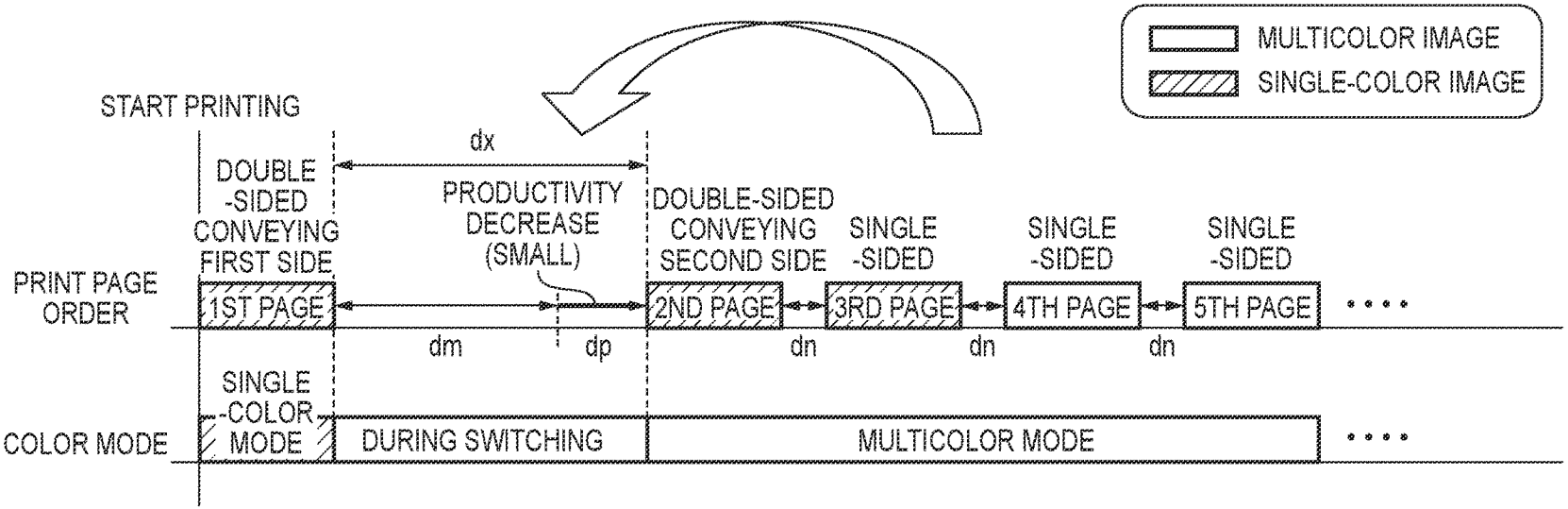

FIG. 7C illustrates improved sheet intervals. As illustrated in FIG. 7C, switching from the single-color mode to the multicolor mode is performed in a sheet interval (the double-sided sheet interval dm) that is relatively longer than the normal sheet interval dn. Note that, because the switching sheet interval dx is longer than the double-sided sheet interval dm, the double-sided sheet interval dm is expanded to the switching sheet interval dx. As is understood by comparing FIG. 7C and FIG. 7B, a sheet interval do that is an indication of the decrease of productivity is reduced to a sheet interval dp which is a difference between the switching sheet interval dx and the double-sided sheet interval dm. In other words, in FIG. 7C image formation completes ahead-of-schedule by a period that corresponds to the difference between the double-sided sheet interval dm and the normal sheet interval dn.

Note that, if the single-color mode is switched to the multicolor mode at a timing that is much more ahead-of-schedule than a timing for forming a multicolor image, the life span of the photosensitive drums 134 for YMC will shorten. Accordingly, configuration may be taken to perform ahead-of-schedule switching from the single-color mode to the multicolor mode by limiting to a case where there is a relatively long sheet interval in a period where a number of single-color images are consecutively formed before a multicolor image is less than or equal to a threshold. For example, the CPU 300 analyzes the print information 400, counts a number n of single-color images consecutively present before a multicolor image, and determines whether the number n of single-color images is less than or equal to the threshold. If the number n of single-color images is less than or equal to the threshold, the CPU 300 investigates each sheet interval in a section where the n single-color images are consecutive, and specifies a relatively long sheet interval. The CPU 300 then performs switching of the color mode in the relatively long sheet interval. If a relatively long sheet interval is not present, switching of the color mode may be performed in a sheet interval between a single-color image and a multicolor image so as to reduce wear of the photosensitive drums 134.

<Relation between Sheet Interval and Time to Switch from Multicolor Mode to Single-Color Mode>

Figure 8A:
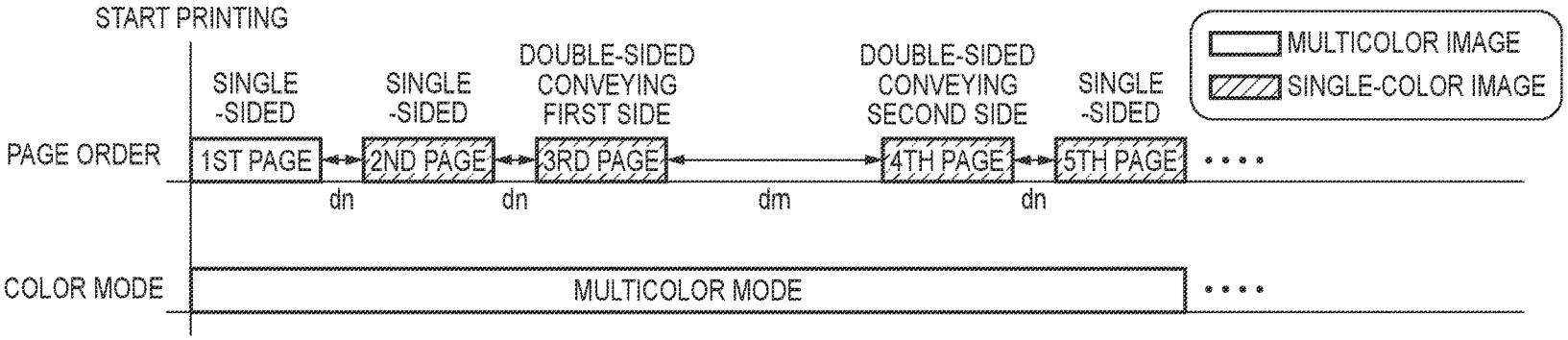
FIGS. 8A, 8B, and 8C are timing charts illustrating jobs that mix single-color images and multicolor images.

In FIG. 7A through FIG. 7C a case of switching from the single-color mode to the multicolor mode was focused on, but there is room for productivity to be improved in a case of switching from the multicolor mode to the single-color mode. FIG. 8A illustrates sheet intervals in a case of forming all pages in the multicolor mode. This case applies to an image forming apparatus that does not have a single-color mode and a contact and separation mechanism, for example. The first page is a sheet on which a multicolor image is formed on one side thereof. The second page is a sheet on which a multicolor image is formed on one side thereof. Here, the third page is the first side in a double-sided print, and a single-color image is formed. Here, the fourth page is the second side in a double-sided print, and a single-color image is formed. The fifth page is a sheet on which a multicolor image is formed on one side thereof.

As described above, in the multicolor mode single-color images can be formed in addition to multicolor images. Accordingly, when a job that mixes single-color images and multicolor images is inputted, the CPU 300 may constantly maintain the multicolor mode and set the sheet interval to the normal sheet interval dn. Because the multicolor mode is constantly set in the case illustrated in FIG. 8A, time to switch the color mode does not occur, but wear of the surface of the photosensitive drums 134*y* to 134*c* progresses.

Figure 8B:
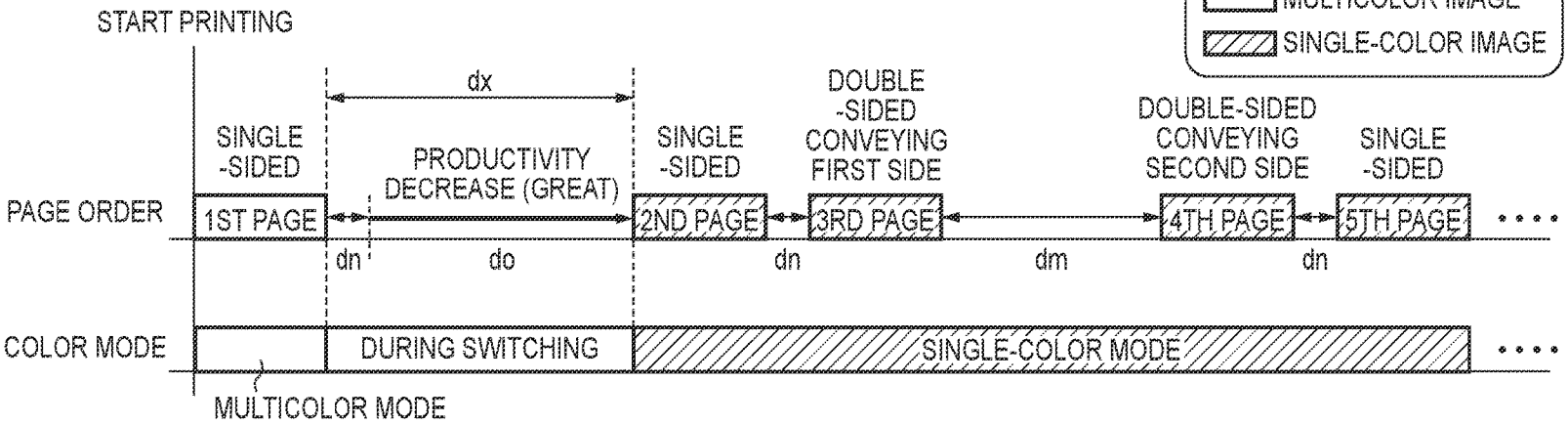

FIG. 8B illustrates a case in which switching from the multicolor mode to the single-color mode is performed in a sheet interval between a multicolor image and a single-color image to reduce wear of the surface of the photosensitive drums 134*y* to 134*c*. Switching time is necessary to perform switching from the multicolor mode to the single-color mode. In other words, the sheet interval is extended from the normal sheet interval dn to the longer switching sheet interval dx. Here, productivity also decreases by a difference do between the switching sheet interval dx and the normal sheet interval dn.

Here, the present application's inventor focused on that a plurality of single-color images are consecutive after the multicolor image, and that the double-sided sheet interval dm for a double-sided print is present. In other words, the inventor realized that productivity will be improved if switching from the multicolor mode to the single-color mode is postponed, and the switching is performed in the double-sided sheet interval dm. Because of this, it is possible to shorten the total of sheet intervals in the job overall.

Figure 8C:
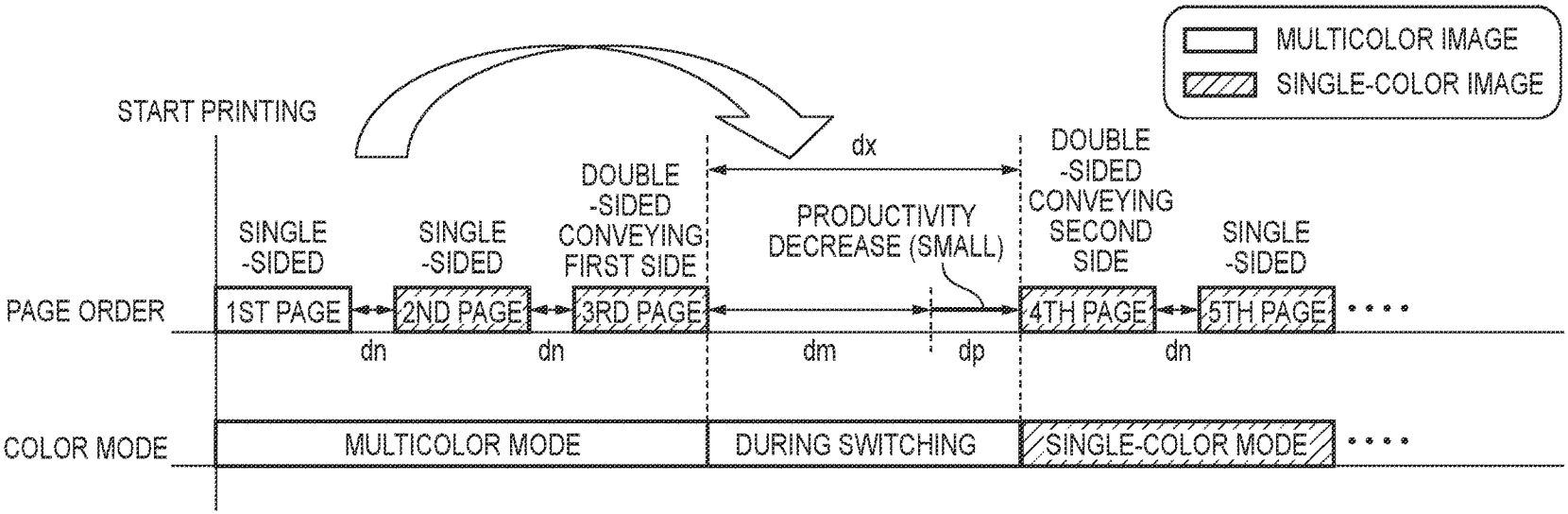

FIG. 8C illustrates improved sheet intervals. As illustrated in FIG. 8C, switching from the multicolor mode to the single-color mode is performed in a sheet interval (the double-sided sheet interval dm) that is relatively longer than the normal sheet interval dn. As is understood by comparing FIG. 8C and FIG. 8B, a sheet interval do that is an indication of the decrease of productivity is reduced to a sheet interval dp which is a difference between the switching sheet interval dx and the double-sided sheet interval dm. In other words, in FIG. 8C image formation completes ahead-of-schedule by a period that corresponds to the difference between the double-sided sheet interval dm and the normal sheet interval dn.

Note that, if the single-color mode is switched to the multicolor mode at a timing that is much later than a timing for first forming a single-color image, the life span of the photosensitive drums 134 for YMC will shorten. Accordingly, configuration may be taken such that, if the number of single-color images to be consecutively formed after a multicolor image is greater than or equal to a threshold, a relatively long sheet interval is searched for, and postponed switching from the multicolor mode to the single-color mode is performed in the relatively long sheet interval. For example, the CPU 300 analyzes the print information 400, counts a number n of single-color images consecutively present after a multicolor image, and determines whether the number n of single-color images is greater than or equal to the threshold. If the number n of single-color images is greater than or equal to the threshold th, the CPU 300 investigates each sheet interval in a section, which is a section that follows a multicolor image, where a number th of single-color images are consecutive, and specifies a relatively long sheet interval. The CPU 300 then performs switching of the color mode in the relatively long sheet interval. If a relatively long sheet interval is not present, switching of the color mode may be performed in a sheet interval between the multicolor image and a single-color image so as to reduce wear of the photosensitive drums 134.

<Color Mode Switch Flowchart>

Figure 9:
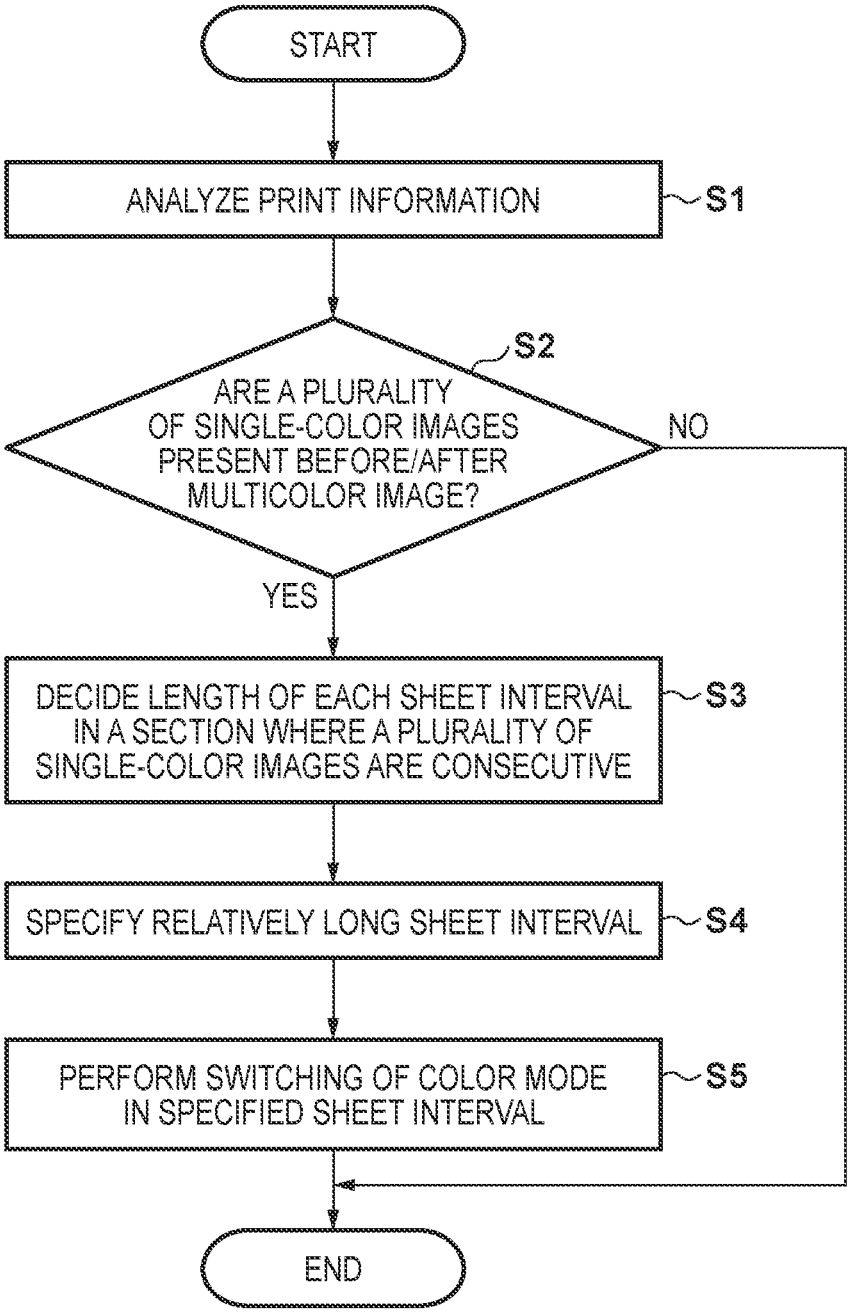
FIG. 9 is a flowchart illustrating a process for switching a color mode.

FIG. 9 is a flowchart that illustrates color mode switching processing that the CPU 300 performs. The CPU 300 performs the following processing in accordance with the control program.

In step S1 the CPU 300 reads the print information 400 from the RAM 302 and analyzes it. For example, the CPU 300 identifies whether an image to be formed on each page is a multicolor image or a single-color image, based on the image data included in the print information 400 of each page. Alternatively, the CPU 300 may identify whether the image to be formed on each page is a multicolor image or a single-color image, in accordance with an instruction included in the print information 400 of each page (an instruction indicating whether to form a multicolor image or to form a single-color image).

In step S2 the CPU 300 determines whether there are a plurality of single-color images before or after a multicolor image, based on a result of the analysis. Note that, when a job for forming only single-color images is inputted, the CPU 300 sets the contact and separation mechanism to the single-color mode (makes an instruction for separation). In addition, when a job for forming only multicolor images is inputted, the CPU 300 sets the contact and separation mechanism to the multicolor mode (makes an instruction for contact). If a plurality of single-color images are not present before or after a multicolor image, the CPU 300 switches the color mode in a sheet interval between the multicolor image and a single-color image. Meanwhile, if a plurality of single-color images are present before or after the multicolor image, the CPU 300 advances the processing to step S3. Note that a plurality of single-color images may be present before a multicolor image, as illustrated in FIG. 7C. In addition a plurality of single-color images may be present after a multicolor image, as illustrated in FIG. 8C.

In step S3 the CPU 300 analyzes the print information 400, and decides the length of each sheet interval in a section where the plurality of single-color images are consecutive. For example, if a double-sided print is designated in the print information 400, the CPU 300 decides the double-sided sheet interval dm for the sheet interval between a page for the first side and a page for the second side. In addition, the CPU 300 decides the normal sheet interval do for a sheet interval between a page onto which a single-sided image is to be formed and a page onto which a single-sided image is to be formed. For example, the CPU 300 decides the normal sheet interval do for a sheet interval before a page for which the sheet feed cassette 100 is designated as the sheet feed port by the print information 400. For example, the CPU 300 decides the double-sided sheet interval dm for a sheet interval before a page for which the double-sided conveying unit 170 is designated as the sheet feed port by the print information 400.

In step S4 the CPU 300 specifies a relatively long sheet interval out of sheet intervals in the section in which the plurality of single-color images are consecutive. For example, if a sheet interval for which the double-sided sheet interval dm has been applied is present, the CPU 300 specifies that sheet interval as the relatively long sheet interval. In the case illustrated in FIG. 7C, the sheet interval between the first page and the second page is specified as the relatively long sheet interval. Note that the CPU 300 expands or extends the double-sided sheet interval dm to the switching sheet interval dx because the switching sheet interval dx is longer than the double-sided sheet interval dm which is the original sheet interval. In the case illustrated in FIG. 8C, the sheet interval between the third page and the fourth page is specified as the relatively long sheet interval. In this case the double-sided sheet interval dm is also extended or expanded to the switching sheet interval dx. Note that extension of the sheet interval is unnecessary if the specified sheet interval is longer than the switching sheet interval dx.

In step S5 the CPU 300 then performs switching of the color mode in the specified sheet interval. In the case illustrated in FIG. 7C, the color mode is switched (ahead-of-schedule switching) from the single-color mode to the multicolor mode in the sheet interval between the first page and the second page. In the case illustrated in FIG. 8C, the color mode is switched (postponed switching) from the multicolor mode to the single-color mode in the sheet interval between the third page and the fourth page.

In this way, in the present embodiment, so that switching of the color mode is performed in a relatively long sheet interval, a timing of switching from the multicolor mode to the single-color mode is postponed, and a timing of switching from the single-color mode to the multicolor mode is made ahead-of-schedule. For example, if a relatively long processing waiting time (sheet interval) is present before a timing at which switching of the color mode should be performed, switching of the color mode is performed ahead-of-schedule. In contrast, if a relatively long processing waiting time (sheet interval) is present after a timing at which switching of the color mode should be performed, switching of the color mode is postponed. Because of this, a decrease of productivity in an image forming job that mixes single-color images and multicolor images is reduced.

<More Detailed Flowchart Relating to Ahead-of-Schedule Switching>

Figure 10:
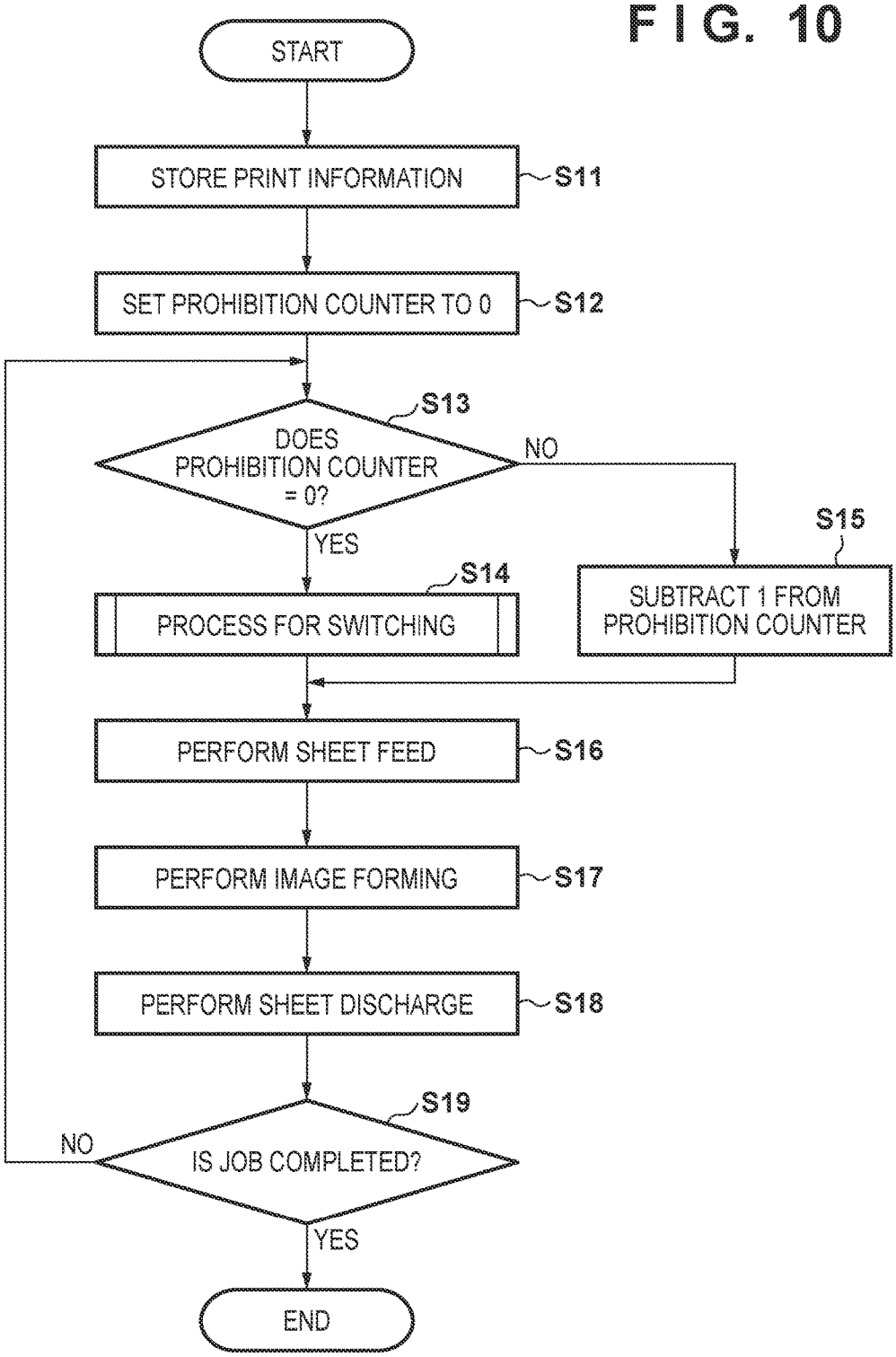
FIG. 10 is a flowchart illustrating image formation processing.

First, explanation is given for ahead-of-schedule switching that was explained using FIG. 7C. FIG. 10 is a more detailed flowchart in relation to ahead-of-schedule switching. When a user (an operator) makes an instruction for printing to the image forming apparatus 1 from the external device 310, the CPU 300 receives the print information 400 from the external device 310.

In step S11, the CPU 300 stores the print information 400 received from the external device 310 in the RAM 302. Subsequently, the CPU 300 reads out the print information 400 from the RAM 302 and uses it, as needed. In step S12 the CPU 300 sets a prohibition counter to 0, as initialization processing. The prohibition counter is a counter that is allocated in the RAM 302 for prohibiting switching of the color mode. The value 0 indicates that switching of the color mode is allowed, and a value other than 0 indicates that switching of the color mode is prohibited.

In step S13 the CPU 300 determines whether switching of the color mode is prohibited, based on the prohibition counter. If the prohibition counter is 0, the CPU 300 determines that switching is allowed, and the processing proceeds to step S14. In step S14 the CPU 300 performs a process for switching as necessary. For example, the CPU 300 determines whether to form an image in the multicolor mode or the single-color mode for each one page. The CPU 300 switches the color mode as necessary based on a result of determining, and the processing proceeds to step S16. Details of the process for switching are described later. Meanwhile, if the prohibition counter is not 0, the CPU 300 determines that switching is prohibited, and the processing proceeds to step S15. In step S15 the CPU 300 subtracts 1 from the prohibition counter, and the processing proceeds to step S16.

In step S16 the CPU 300 feeds a sheet P from the sheet feed port designated by the sheet feed port information 402 of the print information 400. In step S17 the CPU 300 controls the image forming unit 132, and forms an image designated by the image data of the print information 400 on the sheet P. In step S18 the CPU 300 discharges the sheet P to the sheet discharge port designated by the sheet discharge port information 403 of the print information 400.

In step S19 the CPU 300 determines whether the image forming job has completed based on the received print information 400. If image formation for all of the pieces of the print information 400 has completed, the CPU 300 determines that the job has completed, and ends image formation processing. Meanwhile, if the job has not completed, the CPU 300 returns the processing to step S13, and performs image formation for the next page.

Figure 11:
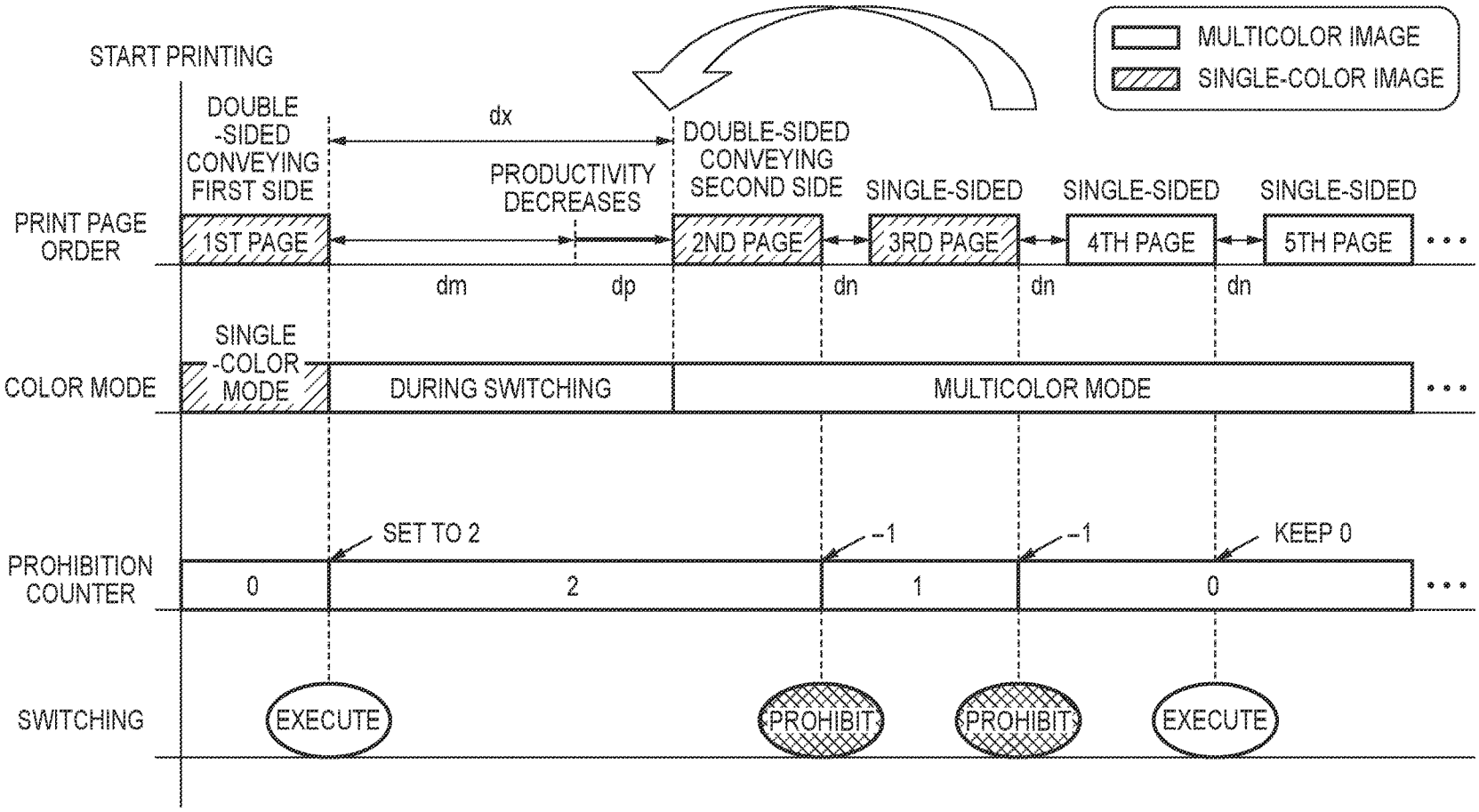
FIG. 11 is a timing chart that illustrates ahead-of-schedule switching.

FIG. 11 is a timing chart that illustrates function of the prohibition counter. Here, a print page order, the color mode, the prohibition counter, and a switching status are illustrated. Note that, regarding the print page order and the color modes in FIG. 11, ones the same as those illustrated in FIG. 7C are envisioned. The CPU 300, by analyzing the print information 400, recognizes that there is a page on which a multicolor image is to be printed after a plurality of pages on which single-color images are to be printed. In addition, the CPU 300 counts a number of pages on which single-color images are to be printed that are present before a page on which a multicolor image is to be printed. For example, if printing of a first page has already ended, the CPU 300 decides 2 as the consecutive number n of single-color images. Note that, when performing a count before printing a first page, the CPU 300 decides 3 as the consecutive number n of single-color images.

Subsequently, the CPU 300 determines whether the consecutive number n of single-color images is less than or equal to a threshold th. Here the threshold th is assumed to be 2. In other words, when printing of the first page ends, the consecutive number n becomes less than or equal to the threshold th. The CPU 300 searches for whether there is a sheet interval that is relatively longer than the sheet interval (the normal sheet interval dn) between the third page on which a single-color image is to be formed and the fourth page on which a multicolor image is to be formed. Because the sheet interval between the first page and the second page is the double-sided sheet interval dm, the CPU 300 determines that it is longer than the normal sheet interval dn between the third page and the fourth page. Note that, assuming that single-color images are formed on a plurality of pages (e.g., page 2 to page 5 in FIG. 8A) after a multicolor image is formed on a previous page (e.g., page 1), as with the sheet interval between the first page and the second page, a sheet interval between a leading page (e.g., page 2) out of a plurality of pages (e.g., page 2 to page 5) for which single-color images are to be formed and the page (e.g., page 1) before that may be referred to as a single-color leading sheet interval. A sheet interval between a final page out of a plurality of pages on which single-color images are to be formed and a page after that may be referred to as a single-color final sheet interval. Because the single-color leading sheet interval is relatively longer than the single-color final sheet interval, the CPU 300 decides to make the timing for switching from the single-color mode to the multicolor mode be ahead-of-schedule in the single-color leading sheet interval.

Here, when timing for switching from the single-color mode to the multicolor mode is made ahead-of-schedule, the CPU 300 must form single-color images from the second page to the third page in the multicolor mode. Typically the CPU 300 would switch to the single-color mode upon discovering print information 400 for a single-color image when operating in the multicolor mode. Accordingly, the CPU 300 must prohibit switching from the multicolor mode to the single-color mode from the second page to the fourth page. Accordingly, in the present embodiment, a prohibition counter for managing a number of times (a number of pages) that a process for switching the color mode is prohibited may be introduced. In the case illustrated in FIG. 11, timing for switching to the multicolor mode is made to be two pages ahead-of-schedule. Accordingly, the CPU 300 sets the prohibition counter to 2. The CPU 300 subtracts 1 from the prohibition counter each time it forms a single-color image. As illustrated in FIG. 11, when image formation to the second page ends, the CPU 300 subtracts 1 from the value of the prohibition counter. When image formation to the third page ends, the CPU 300 subtracts 1 from the value of the prohibition counter. Because of this, at a point when image formation to the third page has ended, the value of the prohibition counter becomes 0. If the prohibition counter is set to a value other than 0, the CPU 300 recognizes that switching of the color mode is prohibited. If the prohibition counter is set to 0, the CPU 300 recognizes that switching of the color mode is permitted. A multicolor image is formed to the fifth page, but switching of the color mode is not performed because the color mode is already set to the multicolor mode.

Details of the Process for Switching

Figure 12:
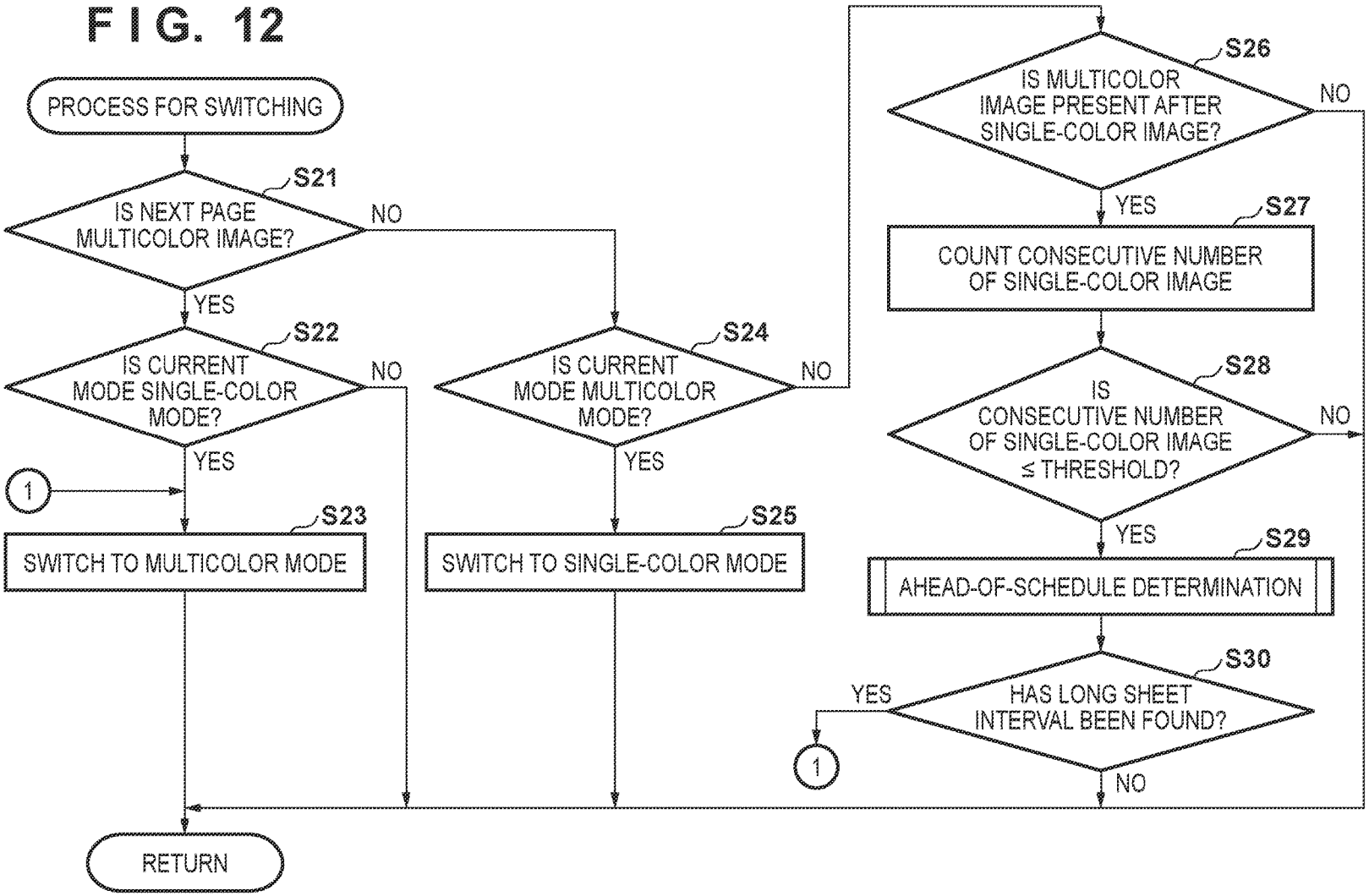
FIG. 12 is a flowchart illustrating a process for switching.

FIG. 12 illustrates in more detail the process for switching of step S14 illustrated by FIG. 10. Note that FIG. 10 corresponds to the main routine, and FIG. 12 corresponds to a subroutine. Switching of the color mode is processing for deciding which of the multicolor mode and the single-color mode to apply, and switching the color mode in accordance with the result of the decision. Upon referring to the prohibition counter in step S13 and recognizing that switching is not prohibited, the CPU 300 performs the following processing.

In step S21 the CPU 300 determines whether the next page is a multicolor image. For example, the CPU 300 refers to the print information 400 stored in the RAM 302, and determines whether the image data 404 included in the print information 400 is data for a multicolor image. If the next page is a single-color image, the CPU 300 advances the processing to step S24. In step S24 the CPU 300 determines whether the current mode is the multicolor mode. The current mode is the color mode set in the image forming apparatus 1 when the processing for determining is performed. If the current mode is the multicolor mode, the CPU 300 advances the processing to step S25. In step S25 the CPU 300 switches to the single-color mode, and returns to the main routine.

Meanwhile, if the next page is determined in step S21 to be a single-color image and the current mode is determined in step S22 to be the single-color mode, the CPU 300 advances the processing to step S26. In step S26 the CPU 300 refers to the print information 400 stored in the RAM 302, and determines whether a multicolor image is present after the single-color image. If a multicolor image is present after the single-color image, the CPU 300 advances the processing to step S27. If a multicolor image is not present after the single-color image, the CPU 300 returns to the main routine.

In step S27 the CPU 300 counts the number of single-color images (the consecutive number n) consecutively present before the multicolor image. In step S28 the CPU 300 determines whether the consecutive number n is less than or equal to a threshold. For example, if the threshold th is two pages and the consecutive number n of single-color images is less than or equal to two pages, the CPU 300 advances the processing to step S29. If the consecutive number n is not less than or equal to the threshold th, the CPU 300 returns to the main routine.

In step S29 the CPU 300 performs an ahead-of-schedule determination. The ahead-of-schedule determination is processing for determining whether to perform switching from the single-color mode to the multicolor mode ahead-of-schedule with respect to the original timing. The original timing is the sheet interval between a preceding single-color image and a succeeding multicolor image. For example, upon determining to make switching to the multicolor mode ahead-of-schedule, the CPU 300 sets the prohibition counter to be a number of times for prohibiting switching to the color mode, and advances the processing to step S30. Note that detail of step S29 is explained later. In step S30, the CPU 300 determines whether a long sheet interval has been found based on the prohibition counter. For example, the CPU 300 refers to the value of the prohibition counter stored in the RAM 302 and determines whether the value of the prohibition counter is 0. If the prohibition counter is set to 0, the CPU 300 recognizes that a relatively long sheet interval has not been found, and returns to the main routine. In other words, ahead-of-schedule switching is not performed. Meanwhile, if the prohibition counter is set to a value other than 0, the CPU 300 recognizes that a relatively long sheet interval has been found, and advances the processing to step S23 so as to make the switching from the single-color mode to the multicolor mode ahead-of-schedule. In step S23, the CPU 300 switches the color mode from the single-color mode to the multicolor mode, and returns to the main routine. Note that, if it is determined in step S13 of the main routine that the prohibition counter is set to a value other than 0, the CPU 300 does not advance the processing to step S14. In other words, a return to the single-color mode from the multicolor mode as illustrated in FIG. 11 is prohibited.

Note that, when it is determined in step S21 that the next page is a multicolor image, the CPU 300 advances the processing to step S22. In step S22 the CPU 300 determines whether the current mode is the single-color mode. If the current mode is the multicolor mode, the CPU 300 returns to the main routine because there is no need to switch the color mode. Meanwhile, if the current mode is the single-color mode, the CPU 300 advances the processing to step S23. In step S23 the CPU 300 switches the color mode from the single-color mode to the multicolor mode, and returns to the main routine.

Details of Ahead-of-Schedule Determination

Figure 13:
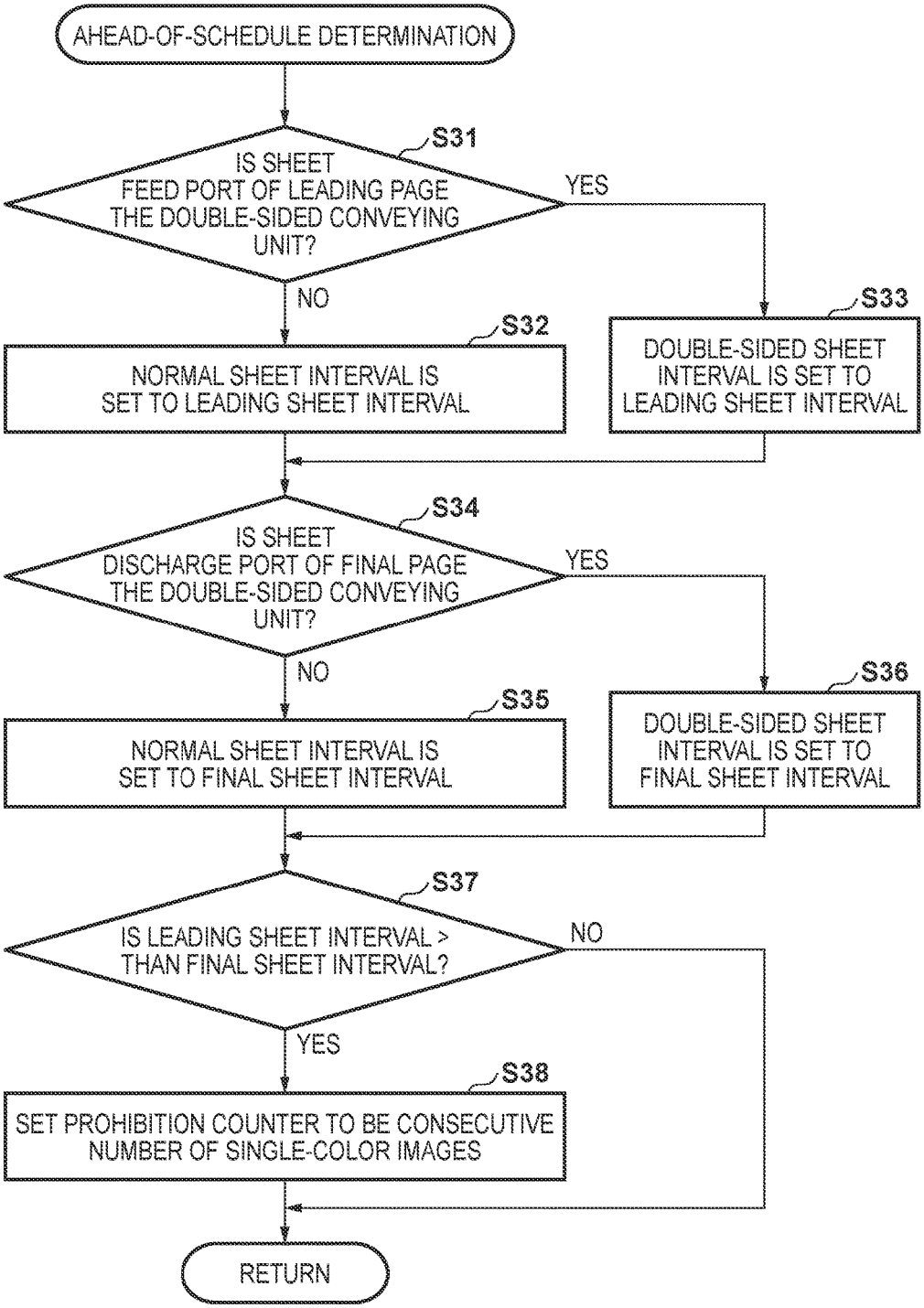
FIG. 13 is a flowchart illustrating an ahead-of-schedule determination.

FIG. 13 is a flowchart that illustrates details of the ahead-of-schedule determination of step S29 which is illustrated in FIG. 12. The ahead-of-schedule determination is processing for searching for a long sheet interval for making switching from the single-color mode to the multicolor mode ahead-of-schedule, and setting a consecutive number of single-color images to the prohibition counter when a long sheet interval is found.

In step S31 the CPU 300 determines whether the sheet feed port of the leading page is the double-sided conveying unit 170. The leading page is the leading page out of a plurality of pages on which single-color images are to be consecutively formed. For example, the CPU 300 refers to the sheet feed port information 402 included in the print information 400 of the leading single-color image out of the plurality of consecutive single-color images, and determines whether the double-sided conveying unit 170 is designated as the sheet feed port. Note that the leading single-color image is the single-color image that is to be formed on the leading page. A sheet P fed from the double-sided conveying unit 170 is a sheet for which an image is to be formed on a second side thereof, causing a long processing waiting time for reversing the front and back thereof to occur. In other words, a relatively long sheet interval (the double-sided sheet interval dm) occurs before the leading page. If the double-sided conveying unit 170 is designated as the sheet feed port, the CPU 300 advances the processing to step S33. In step S33 the CPU 300 sets the sheet interval (a leading sheet interval dl) present before the leading single-color image (the leading page) to be the double-sided sheet interval dm. The leading sheet interval dl may be held in the RAM 302. Upon determining in step S31 that the double-sided conveying unit 170 is designated as the sheet feed port, the CPU 300 advances the processing to step S32. In step S32 the CPU 300 sets the leading sheet interval dl to be the normal sheet interval dn.

In step S34 the CPU 300 determines whether the sheet discharge port of the final page is the double-sided conveying unit 170. The final page is the last page out of a plurality of pages on which single-color images are to be consecutively formed. For example, the CPU 300 refers to the sheet discharge port information 403 included in the print information 400 of the last single-color image out of the plurality of consecutive single-color images, and determines whether the double-sided conveying unit 170 is designated as the sheet discharge port. Note that the last single-color image is the single-color image that is to be formed on the final page. If the sheet discharge port of the final page is the double-sided conveying unit 170, the CPU 300 advances the processing to step S36. In step S36 the CPU 300 sets the final sheet interval dt to be the double-sided sheet interval dm. The final sheet interval dt is a sheet interval present after the final page (between the last single-color image and the multicolor image). Upon determining in step S34 that the sheet discharge port of the final page is not the double-sided conveying unit 170, the CPU 300 advances the processing to step S35. In step S35 the CPU 300 sets the final sheet interval dt to be the normal sheet interval dn.

In step S34 the CPU 300 determines whether the leading sheet interval dl is longer than the final sheet interval dt. If the leading sheet interval dl is not longer than the final sheet interval dt, the CPU 300 returns to the original routine and advances the original routine to step S30 without changing the value of the prohibition counter because ahead-of-schedule switching should not be performed in the leading sheet interval dl. For example, if both of the leading sheet interval dl and the final sheet interval dt are the normal sheet interval dn or the double-sided sheet interval dm, the leading sheet interval dl is not longer than the final sheet interval dt. In addition, if the leading sheet interval dl is the normal sheet interval dn and the final sheet interval dt is the double-sided sheet interval dm, the leading sheet interval dl is not longer than the final sheet interval dt. Meanwhile, if the leading sheet interval dl is longer than the final sheet interval dt, a decrease of productivity is reduced by performing ahead-of-schedule switching in the leading sheet interval dl. Accordingly, the CPU 300 advances processing to step S38. Note that this case is one in which the leading sheet interval dl is the double-sided sheet interval dm and the final sheet interval dt is the normal sheet interval dn. In step S38 the CPU 300 sets the prohibition counter to be the consecutive number n of single-color images, and advances the processing to step S30 of the original routine. The consecutive number n is the count value obtained in step S27 of the original routine.

By virtue of this embodiment, by making switching from the single-color mode to the multicolor mode ahead-of-schedule, a decrease of productivity is reduced. For example, there are cases in which there are a plurality of consecutive single-color images before a multicolor image, and one sheet interval present in a section in which the plurality of single-color images are consecutive is longer than the sheet interval between the multicolor image and a single-color image. When double-sided printing is performed in a section in which a plurality of single-color images are consecutive, some sheet intervals become longer to reverse the front and back of a sheet P. Accordingly, by performing switching of the color mode in such a relatively long sheet interval, a decrease of productivity is reduced when seen from the entirety of the job. In FIG. 11 an example in which the threshold th is two pages is illustrated. However, this does not limit the present invention. When a large value is set to the threshold th, it becomes easier to find a long sheet interval, but a number of pages (single-color images) to be made ahead-of-schedule increases. In other words, there are more single-color images to be formed in the multicolor mode, and wear of the YMC photosensitive drums 134 increases. When a small value is set to the threshold th, it becomes hard to find a long sheet interval, but a number of pages (single-color images) to be made ahead-of-schedule decreases. In other words, cases in which it is not possible to reduce a decrease in productivity occur, but wear of the YMC photosensitive drums 134 is reduced. In this way, the threshold th is a trade-off between productivity and wear of the YMC photosensitive drums 134. Accordingly, the threshold th is set to a value so that a balance between productivity and wear of the YMC photosensitive drums 134 is achieved.

<More Detailed Flowchart Relating to Postponed Switching>

Figure 14:
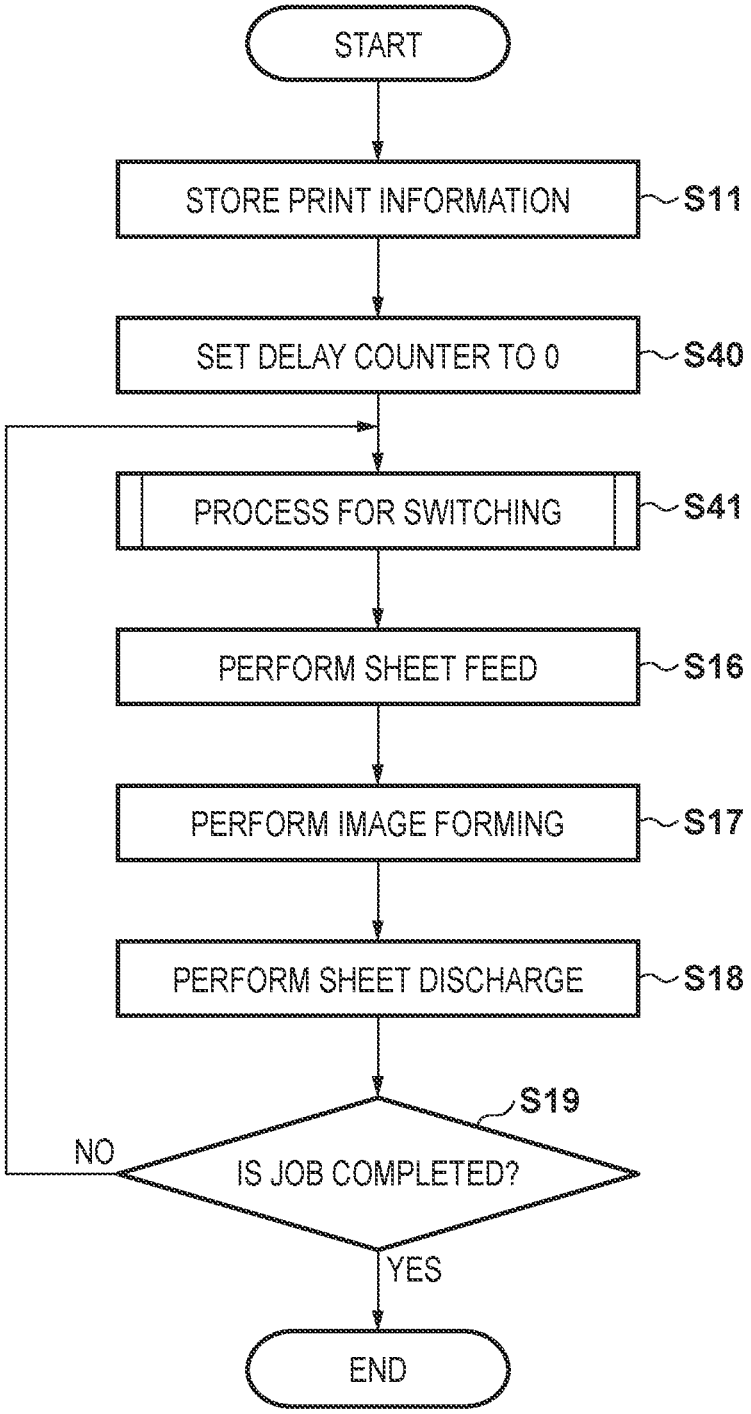
FIG. 14 is a flowchart illustrating image formation processing.

Next, explanation is given for postponed switching that was explained using FIG. 8C. FIG. 14 is a more detailed flowchart in relation to postponed switching. Note that, in FIG. 14, the same reference numeral is applied to steps that are shared with FIG. 10. A point of difference between FIG. 14 and FIG. 10 is that step S13 through step S15 are replaced by step S40 and step S41.

In step S40 the CPU 300 sets a delay counter to 0, as initialization processing. The delay counter is a counter used for delaying timing for switching from the multicolor mode to the single-color mode, and is stored in the RAM 302. In step S41 the CPU 300 performs switching from the multicolor mode to the single-color mode in accordance with the delay counter.

Figure 15:
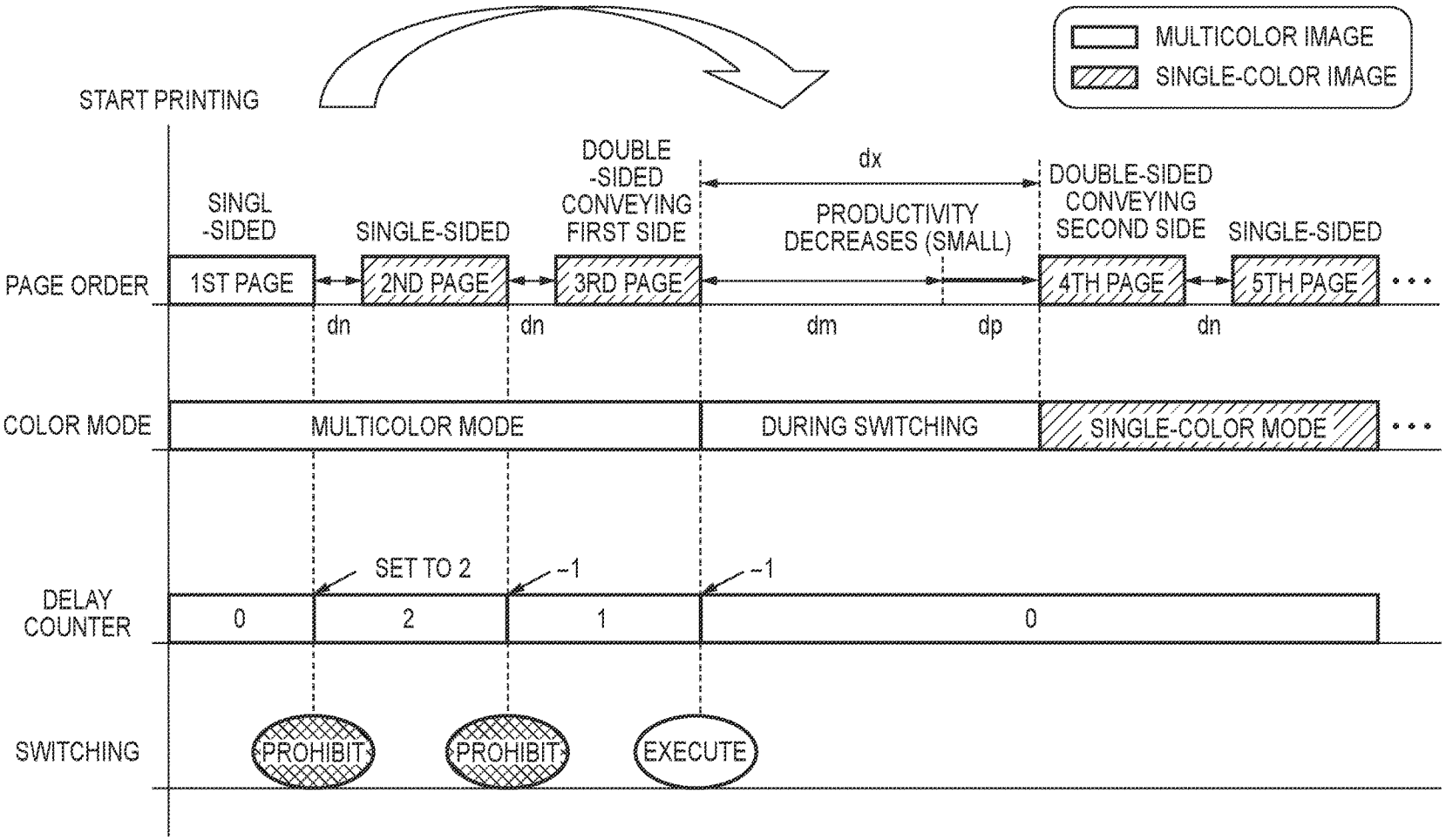
FIG. 15 is a timing chart that illustrates postponed switching.

FIG. 15 is a timing chart that illustrates function of the delay counter. Here, a print page order, the color mode, the delay counter, and a switching status are illustrated. Note that, regarding the print page order and the color modes in FIG. 15, ones the same as those illustrated in FIG. 8C are envisioned.

For example, when forming a multicolor image in the multicolor mode, the CPU 300 determines based on the print information 400 whether a predetermined number or more of single-color images are consecutively present after the multicolor image. In other words, if the consecutive number n of single-color images is greater than or equal to the threshold th, the CPU 300 determines that switching from the multicolor mode to the single-color mode is necessary. In this example, four single-color images are consecutive after one multicolor image. In addition, it is assumed that the threshold th is set to 3. The CPU 300 determines whether a sheet interval that is relatively longer than the sheet interval present before a leading image out of the th single-color images is present between the leading image and a final image. The final image is a single-color image finally formed out of the th single-color images. In FIG. 15 the leading image is the single-color image formed on the second page. The final image is the single-color image formed on the fourth page. Upon discovering a sheet interval that is relatively longer than the sheet interval between the multicolor image and the leading image, the CPU 300 performs switching from the multicolor mode to the single-color mode in the discovered sheet interval. In this example, the sheet interval between the multicolor image and the leading image is the normal sheet interval dn, and the sheet interval before the final image is the double-sided sheet interval dm. Accordingly, the CPU 300 specifies the double-sided sheet interval dm between the third page and the fourth page as the relatively long sheet interval. Switching that was originally to be performed between the first page and the second page is performed in the sheet interval between the third page and the fourth page. Accordingly, the CPU 300 sets the delay counter to be 2 to postpone (delay) the switch timing by two pages. The CPU 300 subtracts 1 from the delay counter each time it forms an image on one page. When image formation to the third page completes, the delay counter becomes 0. Accordingly, the CPU 300 performs the switching of the color mode.

In this way, switching of the color mode is postponed (delayed). The delay counter indicates a number of pages for which switching is delayed with respect to an original switch timing. If the delay counter is set to a value other than 0, the CPU 300 does not perform switching, and reduces the value of the delay counter by 1. Meanwhile, at the timing when the value of the delay counter has become 0, the CPU 300 performs switching from the multicolor mode to the single-color mode.

Details of the Process for Switching

Figure 16:
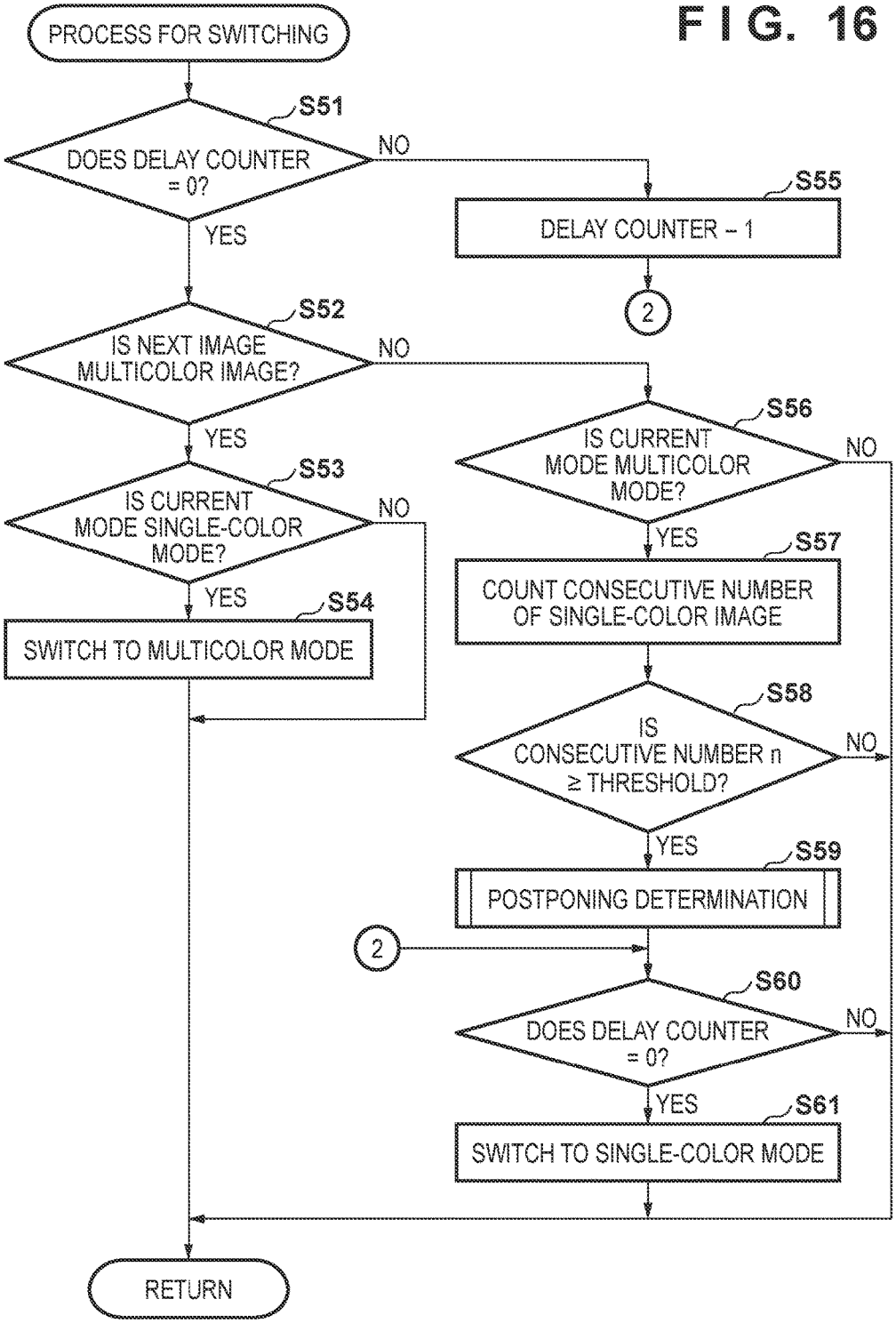
FIG. 16 is a flowchart illustrating a process for switching.

FIG. 16 is a flowchart that illustrates details of the process for switching of step S41 which is illustrated in FIG. 14. Note that the subroutine illustrated in FIG. 16 is assumed to be called from the main routine illustrated in FIG. 14. As is clear from the flowchart of FIG. 14, a process for switching is performed for each single page.

In step S51 the CPU 300 determines whether the value of the delay counter is 0. In other words the CPU 300 determines whether delayed switching is reserved based on the delay counter. The delay counter is held in the RAM 302. If the delay counter is 0, the CPU 300 advances the processing to step S52 because switching of the color mode is permitted. In step S52 the CPU 300 determines whether the next image is a multicolor image. For example, the CPU 300 refers to the image data 404 included in the print information 400 of the page that is to be the next printing target, and determines whether the image data 404 is image data for a multicolor image. Here, if the next image is a multicolor image, the CPU 300 advances the processing to step S53. In step S53 the CPU 300 determines whether the current mode is the single-color mode. Here, if the current mode is the single-color mode, the CPU 300 advances the processing to step S54. In step S54 the CPU 300 performs switching from the single-color mode to the multicolor mode, and then returns to the main routine illustrated in FIG. 14.

Meanwhile, if it is determined in step S51 that the delay counter is 0 and it is determined in step S52 that the next image is a single-color image, the CPU 300 advances the processing to step S56. In step S56 the CPU 300 determines whether the current mode is the multicolor mode. If the current mode is the single-color mode, the CPU 300 returns to the main routine because switching is not needed. Meanwhile, if the current mode is the multicolor mode, the CPU 300 advances the processing to step S57.

In step S57 the CPU 300 counts a consecutive number n of single-color images present after the multicolor image, based on the print information 400. In step S58 the CPU 300 determines whether the consecutive number n is greater than or equal to the threshold th. If the consecutive number n is not greater than or equal to the threshold th, the CPU 300 does not perform switching to the single-color mode, and continues in the multicolor mode. Because of this, the productivity improves. Accordingly, if the consecutive number n is not greater than or equal to the threshold th, the CPU 300 returns to the main routine. Meanwhile, if the consecutive number n is greater than or equal to the threshold th, the CPU 300 advances the processing to step S59.

Note that, if the consecutive number n is greater than or equal to the threshold th, the CPU 300 recognizes that switching from the multicolor mode to the single-color mode is necessary, but the problem is what timing to do so. Accordingly, the CPU 300 advances processing to step S59. In step S59 the CPU 300 performs a postponing determination for deciding the switch timing. As explained by using FIG. 15, the postponing determination is processing for searching for whether there is a sheet interval longer than the leading sheet interval that is the original switch timing. If a sheet interval that is relatively longer than the leading sheet interval is found, the found sheet interval is decided to be the switch timing. In other words, a value indicating the switch timing is stored in the delay counter. As explained by using FIG. 15, if the switch timing is postponed by two pages from the original timing, the delay counter is set to be 2. Note that detail of step S59 is explained later.

In step S60 the CPU 300 obtains the value of the delay counter from the RAM 302, and, by determining whether the value of the delay counter is 0, determines whether to postpone switching to the single-color mode. Here, if the delay counter is set to a value other than 0, the CPU 300 skips switching to the single-color mode, and returns to the main routine. Meanwhile, if the delay counter is set to 0, the CPU 300 advances the processing to step S61. In step S61 the CPU 300 switches from the multicolor mode to the single-color mode.

Incidentally, if it is determined in step S51 that the delay counter is set to a value other than 0, the CPU 300 advances the processing to step S55. Thus a case where the delay counter is set to a value other than 0 is a case in which, although a sheet interval that is relatively longer than the leading sheet interval has been found, that sheet interval has not arrived. FIG. 15 is a case in which the sheet interval between the second page and the third page becomes the processing target in accordance with the CPU 300. In step S55 the CPU 300 reduces the value of the delay counter by 1, and the processing proceeds to step S60.

Details of Postponing Determination

Figure 17:
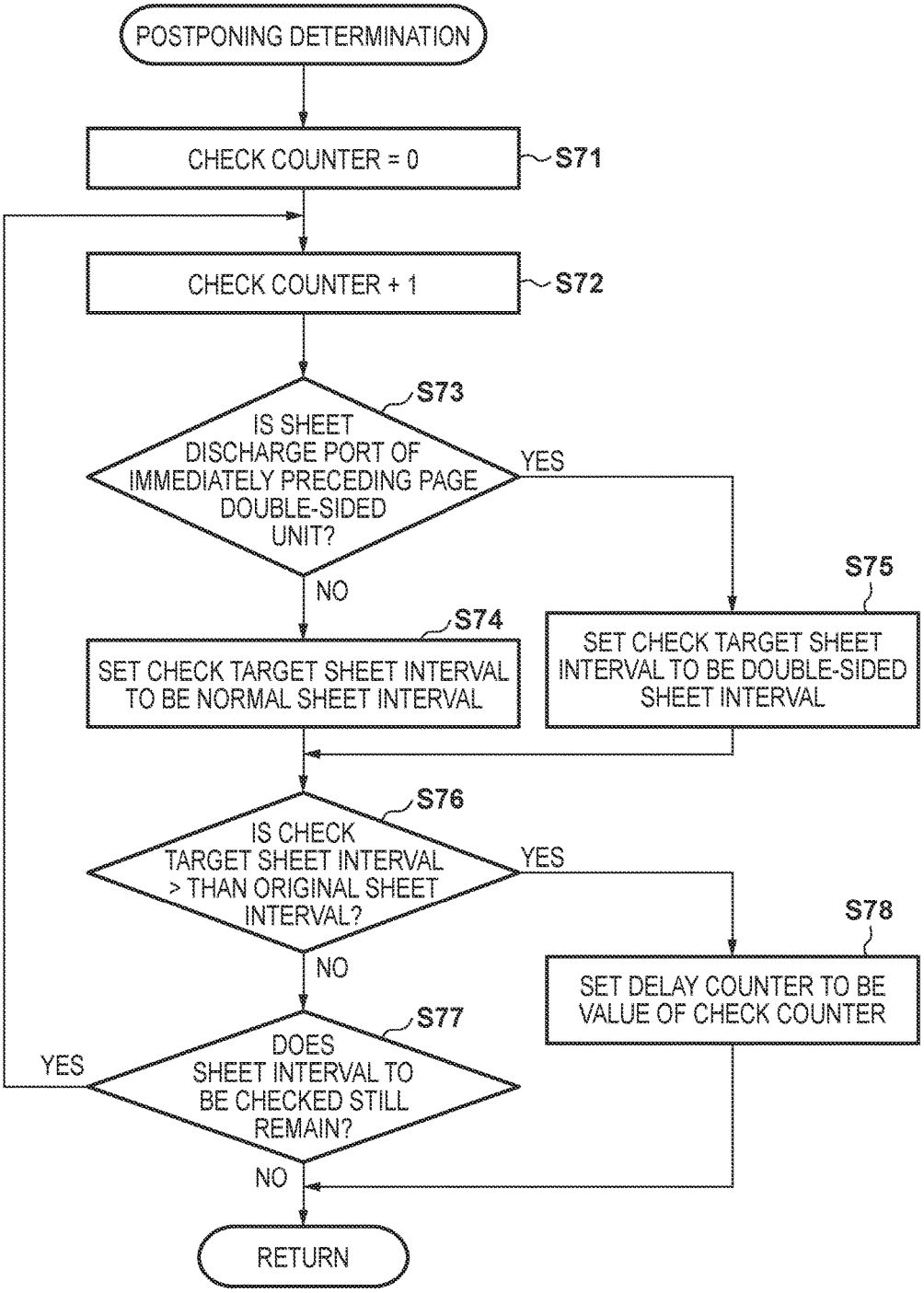
FIG. 17 is a flowchart illustrating a postponing determination.

FIG. 17 is a flowchart that illustrates details of the postponing determination of step S59 which is illustrated in FIG. 16. The postponing determination is processing for searching for a sheet interval that is relatively longer that a sheet interval that is present between a multicolor image and a single-color image. Note that the search area is the threshold's worth of single-color images present after a multicolor image. Note that a sheet interval present between a multicolor image and a single-color image is the sheet interval for which switching would originally be performed, and is referred to as the original sheet interval.

In step S71 the CPU 300 sets a check counter to 0, as initialization processing. In the postponing determination, information for specifying the sheet interval in which switching from the multicolor mode to the single-color mode is to be performed is necessary. For example, information indicating by how many pages the sheet interval for which switching is to be performed is positioned after the original sheet interval is necessary. A check counter for holding this information is stored in the RAM 302.

In step S72 the CPU 300 increments the value of the check counter by 1. In this way, the check counter is incremented each time a sheet interval that is a check target is moved to a sheet interval that is one behind. In step S73 the CPU 300 determines whether the sheet discharge port of the immediately preceding page is the double-sided conveying unit 170. The immediately preceding page is a page present immediately preceding to the sheet interval that is the check target. As illustrated in FIG. 15, if the check target sheet interval is the sheet interval between the second page and the third page, the immediately preceding page is the second page. The CPU 300 refers to the sheet discharge port information 403 included in the print information 400 for the immediately preceding page, and determines whether the double-sided conveying unit 170 is designated as the sheet discharge port. If the sheet discharge port information 403 designates the sheet discharge tray 160, the CPU 300 advances the processing to step S74. In step S74 the CPU 300 sets the check target sheet interval to be the normal sheet interval dn, and advances the processing to step S76. Meanwhile, if the sheet discharge port information 403 designates the double-sided conveying unit 170, the CPU 300 advances the processing to step S75. In step S75 the CPU 300 sets the check target sheet interval to be the double-sided sheet interval dm, and advances the processing to step S76.

In step S76 the CPU 300 determines whether the check target sheet interval is relatively longer than the original sheet interval. If the original sheet interval is the normal sheet interval and the check target sheet interval is also the normal sheet interval, the CPU 300 advances the processing to step S77 because the check target sheet interval is not relatively longer than the original sheet interval. In step S77 the CPU 300 determines whether a sheet interval to be checked still remains. For example, if the threshold th is 3, the number of sheet intervals to be checked is 2. Accordingly, if the number of sheet intervals for which checking has completed is smaller than (the threshold—1), the CPU 300 determines that a sheet interval to be checked still remains. If the number of sheet intervals for which checking has completed matches (the threshold—1), the CPU 300 determines that a sheet interval to be checked does not remain.

Meanwhile, in step S76, if the original sheet interval is the normal sheet interval and the check target sheet interval is the double-sided sheet interval, the CPU 300 advances the processing to step S78 because the check target sheet interval is relatively longer than the original sheet interval. In step S78 the CPU 300 sets the delay counter to be the value of the check counter, and returns to the original routine.

By virtue of this embodiment, by postponing switching from the single-color mode to the multicolor mode, a decrease of productivity is reduced. For example, there are cases in which there are a plurality of consecutive single-color images after a multicolor image, and one sheet interval present in a section in which the plurality of single-color images are consecutive is longer than the sheet interval between the multicolor image and a single-color image. When double-sided printing is performed in a section in which a plurality of single-color images are consecutive, some sheet intervals become longer to reverse the front and back of a sheet P. Accordingly, by performing switching of the color mode in such a relatively long sheet interval, a decrease of productivity is reduced when seen from the entirety of the print job. In FIG. 15 an example in which the threshold th is three pages is illustrated. However, this does not limit the present invention. When a large value is set to the threshold th, it becomes easier to find a long sheet interval, but a number of pages (single-color images) to be postponed increases. In other words, there are more single-color images to be formed in the multicolor mode, and wear of the YMC photosensitive drums 134 increases. In contrast, when a small value is set to the threshold th, it becomes hard to find a long sheet interval, but a number of pages (single-color images) to be postponed decreases. In other words, cases in which it is not possible to attempt to improve productivity occur, but wear of the YMC photosensitive drums 134 is reduced. In this way, the threshold th is a trade-off between productivity and wear of the YMC photosensitive drums 134. Accordingly, the threshold th is set to a value so that a balance between productivity and wear of the YMC photosensitive drums 134 is achieved.

<Summary>

The image forming apparatus 1 improves productivity by performing switching from the single-color mode to the multicolor mode and switching from the multicolor mode to the single-color mode in a long sheet interval. As illustrated in FIG. 11 or the like, upon receiving a job in which a plurality of single-color images are to be formed before a multicolor image, the image forming apparatus 1 searches for a relatively long sheet interval out of a number of sheet intervals present among the plurality of single-color images. The image forming apparatus 1 forms in order some of the single-color images included in the plurality of single-color images in the single-color mode until the relatively long sheet interval, and then switches from the single-color mode to the multicolor mode in the relatively long sheet interval. After the relatively long sheet interval, the image forming apparatus 1 forms in order the remaining single-color images out of the plurality of single-color images and the multicolor image in the multicolor mode. In contrast, as illustrated in FIG. 15 or the like, upon receiving a job in which a plurality of single-color images are to be formed after a multicolor image, the image forming apparatus 1 searches for a relatively long sheet interval out of a number of sheet intervals present among the plurality of single-color images. The image forming apparatus 1 forms in order the multicolor image and some of the single-color images included in the plurality of single-color images in the multicolor mode until the relatively long sheet interval, and then switches from the multicolor mode to the single-color mode in this sheet interval. Subsequently, after the relatively long sheet interval, the image forming apparatus 1 forms in order the remaining single-color images included in the plurality of single-color images in the single-color mode.

As explained by using FIG. 1, the image forming unit 132*k* is an example of a first forming unit for forming an image by using toner of a first color (example: black). The image forming units 132*y*, 132*m*, and 132*c* are examples of a second forming unit for forming an image by using toner of a second color (examples: yellow, magenta, and cyan). The intermediate transfer belt 131 is an example of an intermediate transfer member on which at least an image from the image forming unit 132*k* is transferred. The contact and separation mechanism 333 is an example of a contact and separation unit that has a multicolor mode and a single-color mode. The contact and separation mechanism 333 is a mechanism for causing the intermediate transfer member to be in contact with or separated from an image carrier of the second forming unit. The multicolor mode is a color mode in which the intermediate transfer belt 131 is caused to be in contact with both of the image forming unit 132*k* and the image forming units 132*y*, 132*m*, and 132*c*. The single-color mode is a color mode in which the intermediate transfer belt 131 is caused to be separated from the image forming units 132*y*, 132*m*, and 132*c* while the intermediate transfer belt 131 is caused to be in contact with the image forming unit 132*k*. The CPU 300 is an example of a control unit for controlling the image forming units 132*k*, 132*y*, 132*m*, and 132*c* to form a multicolor image that superimposes an image that uses toner of the second color and an image that uses toner of the first color, or to form a single-color image that uses only the toner of the first color. The CPU 300 is inputted with a job for which switching from the single-color mode to the multicolor mode is necessary, wherein the job mixes pages on which multicolor images are to be formed and pages on which single-color images are to be formed. As explained as ahead-of-schedule switching, the CPU 300 switches from the single-color mode to the multicolor mode during a processing waiting time that is relatively long, out of processing waiting times between preceding pages and succeeding pages in the job. The CPU 300 is inputted with a job for which switching from the multicolor mode to the single-color mode is necessary, being a job that mixes pages on which multicolor images are to be formed and pages on which single-color images are to be formed. As explained as postponed switching, the CPU 300 switches from the multicolor mode to the single-color mode during a processing waiting time that is relatively long, out of processing waiting times between preceding pages and succeeding pages in the job. In this way, if switching from the single-color mode to the multicolor mode is necessary in an inputted job, the single-color mode is switched to the multicolor mode during a relatively long processing waiting time out of processing waiting times between a preceding page and a succeeding page, before the page in the job on which a multicolor image is to be formed.

Figure 18:
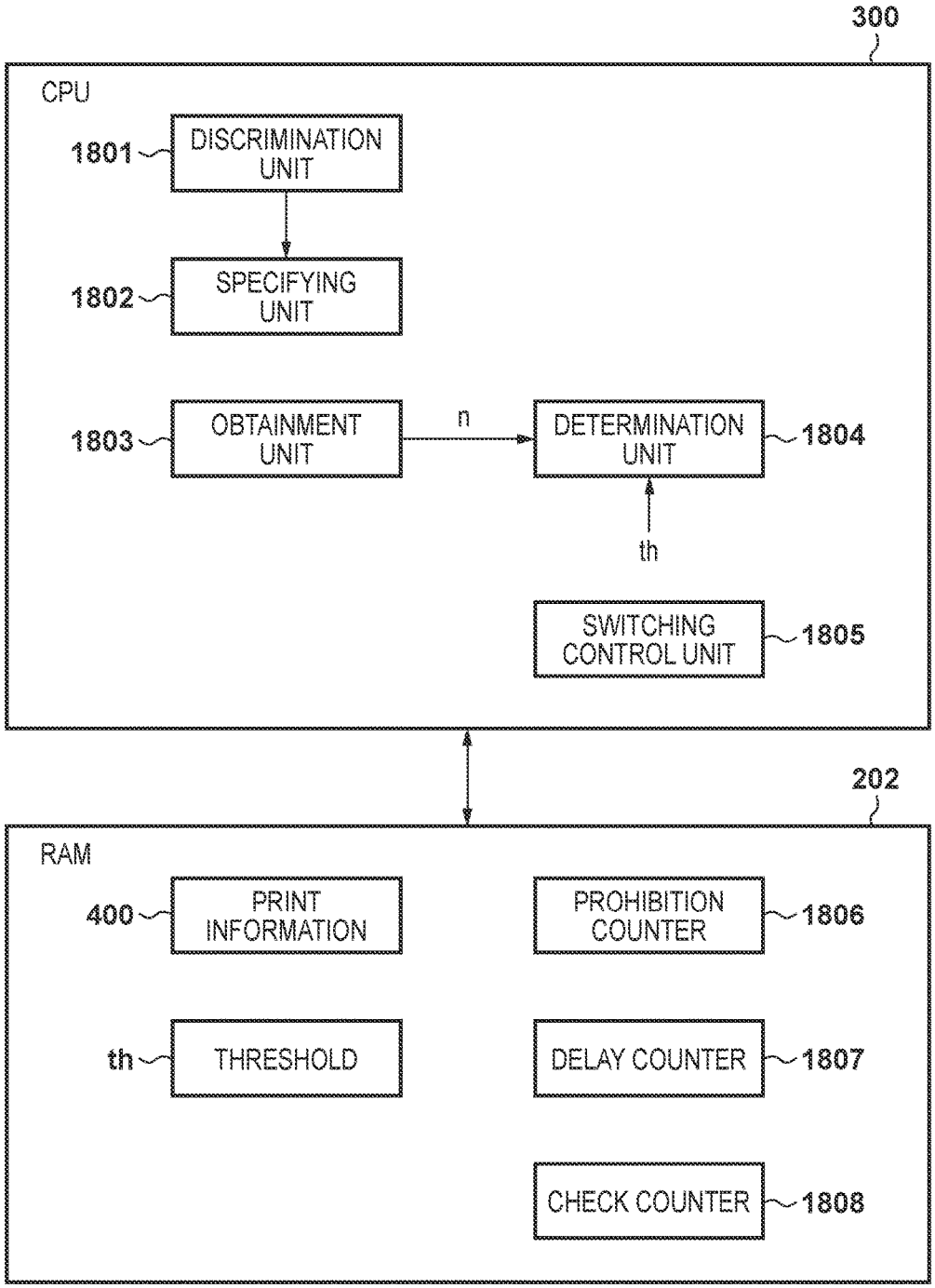
FIG. 18 is a view that illustrates functions realized by a CPU.

FIG. 18 illustrates an example of functions that are realized by the CPU 300 executing a control program. Some or all of the functions provided by the CPU 300 may be realized by hardware such as an ASIC or an FPGA. ASIC is an abbreviation for application specific integrated circuit. FPGA is an abbreviation for field-programmable gate array.

A discrimination unit 1801 has a discriminating function/decision function that analyzes a job (the print information 400) and discriminates the processing waiting times (the so-called sheet interval) between the pages. As explained in relation to step S3, step S31 and step S34, the sheet feed port information 402 or the sheet discharge port information 403 are referred to, and the sheet intervals between the pages are decided. As explained in relation to step S4 or step S37, a specifying unit 1802 has a specifying function that specifies a relatively long processing waiting time based on a result of the discriminating by the discrimination unit 1801. In this way, the relatively long sheet interval may be specified by referring to job data such as the print information 400.

The relatively long processing waiting time may be a processing waiting time that is allocated for forming an image on both sides of a sheet P (example: the double-sided sheet interval dm). To form an image of a second side of the sheet P after forming an image on the first side of the sheet P, processing to reverse the front and back of the sheet P is necessary, and the sheet interval becomes long. Accordingly, if switching of the color mode is performed in this sheet interval, productivity will improve. Although the double-sided sheet interval dm was employed as an example of a relatively long sheet interval, it is merely an example. A relatively long sheet interval may occur due to another reason. For example, when sheets P having a short length (width) in a direction perpendicular to a conveyance direction are consecutively fed to the fixing apparatus 140, an edge portion of the fixing apparatus 140 will rise to a temperature greater than that of a central portion thereof. This is because the sheet P is only passing through the central portion of the fixing apparatus 140. To reduce such a rise in temperature, the CPU 300 may extend sheet intervals when such sheets P having a small size are designated. Accordingly, switching of the color mode may be performed in a sheet interval that is extended to reduce a rise in temperature of the fixing apparatus 140. In this way, a relatively long processing waiting time may be a processing waiting time allocated to reduce a localized rise in temperature of a part (e.g., edge part) of the fixing unit.

In addition, the image forming apparatus 1 may extend a sheet interval between a preceding image and a succeeding image and form an image for measurement on the intermediate transfer belt 131, to correct color misregistration, image density, or the like. Note that color misregistration occurs due to image formation positions for each color shifting from ideal positions. Accordingly, the CPU 300 may switch the color mode in a sheet interval that is extended to perform correction processing. In other words, a relatively long processing waiting time may be a processing waiting time that is allocated to perform correction processing for correcting shifting of image formation positions. In addition, the relatively long processing waiting time may be a processing waiting time that is allocated to perform correction processing for correcting image density.

In addition, a post-processing apparatus for performing hole punching, binding processing, stapling processing, or the like may be connected to the image forming apparatus 1. The image forming apparatus 1 cannot convey a sheet P to the post-processing apparatus until preparation to accommodate the sheet P in the post-processing apparatus completes. In other words, the sheet interval is extended. In this way, the CPU 300 may switch the color mode in a sheet interval that is extended due to a post-processing apparatus. In other words, a relatively long processing waiting time may be a processing waiting time allocated for a post-processing apparatus.

The image forming apparatus 1 may be equipped with a plurality of sheet feed ports. The CPU 300 may extend a sheet interval to switch sheet feed ports. Accordingly, the CPU 300 may switch the color mode in a sheet interval that is extended for switching the sheet feed port. In this way, a relatively long processing waiting time may be a processing waiting time allocated for switching the sheet feed port.

As illustrated in FIG. 7C, by switching from the single-color mode to the multicolor mode during the relatively long processing waiting time, the CPU 300 uses the multicolor mode to form single-color images on some of the pages in the job. In this way, the image forming apparatus 1 can form single-color images in addition to multicolor images in the multicolor mode. Accordingly, a decrease of productivity is reduced by switching from the single-color mode to the multicolor mode at an ahead-of-schedule timing relative to the original timing.

Although explanation was given in FIG. 11 and FIG. 12 using a consecutive number n, the technical concept of the embodiment may be further generalized. If, in the job, a multicolor image is formed on the i-th page, single-color images are formed on the i−j-th to the i−1-th pages, and the processing waiting time between the i−j−1-th page and the i−j-th page is relatively longer than the processing waiting time between the i−1-th page and the i-th page, the CPU 300 performs switching from the single-color mode to the multicolor mode during the processing waiting time between the i−j−1-th page and the i−j-th page. Because of this, single-color images are formed using the multicolor mode for the i−j-th to the i−1-th pages. Note that, in the example illustrated in FIG. 11, i is 4 and j is 2. In other words, i corresponds to the consecutive number n and j corresponds to the threshold th.

As explained by using FIG. 11, FIG. 12, or FIG. 13, a switching control unit 1805 of the CPU 300 may function as a prohibition unit for prohibiting switching from the multicolor mode to the single-color mode during processing waiting times present between the i−j-th page to the i-th page. In the example illustrated in FIG. 11, switching of the color mode is prohibited in the two sheet intervals present between the second page to the fourth page. The switching control unit 1805 may prohibit switching from the multicolor mode to the single-color mode by using a prohibition counter 1806.

As illustrated by FIG. 18 or step S27, an obtainment unit 1803 has an obtaining function that obtains a number of pages j (the consecutive number n) from the i−j-th page to the i−1-th page. As explained in relation to step S28, a determination unit 1804 has a determination function that determines whether the number of pages j is less than or equal to a threshold. Note that, if the number of pages j is less than or equal to the threshold, the switching control unit 1805 has a switching function that may perform switching from the single-color mode to the multicolor mode during the processing waiting time between the i−j−1-th page and the i−j-th page. In other words, configuration may be taken to perform switching of the color mode in the sheet interval present before the leading image out of a plurality of consecutive single-color images. In particular, productivity improves if this sheet interval is a relatively long sheet interval. Meanwhile, if the number of pages j is not less than or equal to the threshold, the switching control unit 1805 may perform switching from the single-color mode to the multicolor mode during the processing waiting time between the i−1-th page and the i-th page. In other words, if a plurality of consecutive single-color images is not sufficiently present, switching of the color mode may be performed in the sheet interval between the last single-color image and the multicolor image.

As explained by using FIG. 8C or the like, the CPU 300 is inputted with a job for which switching from the multicolor mode to the single-color mode is necessary, being a job that mixes pages on which single-color images are formed and pages on which multicolor images are formed. The CPU 300 may use the multicolor mode to form single-color images on some of the pages in the job by switching from the multicolor mode to the single-color mode during a relatively long processing waiting time out of processing waiting times between a preceding page and a succeeding page in the job. Because of this, the productivity improves. For example, as illustrated in FIG. 8C or FIG. 15, switching from the multicolor mode to the single-color mode may be postponed to be later than an original timing and then performed.

Specific examples are illustrated in FIG. 8C or FIG. 15, but the technical concept of the present embodiment may be generalized as follows. There are cases where in a job a multicolor image is formed on the i-th page, and single-color images are formed on each of the i+1-th page to the i+k-th page. A case in which i=1 and k=3 is illustrated in FIG. 8C or FIG. 15. If the processing waiting time between the i+k−1-th page and the i+k-th page is relatively longer than the processing waiting time between the i-th page and the i+1-th page, the CPU 300 performs switching from the multicolor mode to the single-color mode during the processing waiting time between the i+k−1-th page and the i+k-th page. In such a case the CPU 300 uses the multicolor mode to form single-color images on each of the pages from the i+1-th page to the i+k−1-th page. Because of this, the productivity improves.

As illustrated in FIG. 15, the CPU 300 prohibits switching from the multicolor mode to the single-color mode during the processing waiting times that are present from the i+1-th page to the i+k−1-th page. Because single-color images are formed from the i+1-th page to the i+k−1-th page, switching to the single-color mode is performed in a normal case. Accordingly, by using a delay counter 1807 or a check counter 1808, the switching control unit 1805 may prohibit switching in the normal sheet interval do and permit switching in a longer sheet interval.

As explained in relation to step S57, the obtainment unit 1803 obtains a number of pages k from i+1-th page to i+k-th page. Here k corresponds to the consecutive number n. The determination unit 1804 determines whether the number of pages k is greater than or equal to a threshold. Note that, if the number of pages k is greater than or equal to the threshold, the switching control unit 1805 may perform switching from the multicolor mode to the single-color mode during the processing waiting time between the i+k−1-th page and the i+k-th page. Note that, if the number of pages k is not greater than or equal to the threshold, the switching control unit 1805 may perform switching from the multicolor mode to the single-color mode during a processing waiting time between the i-th page and the i+1-th page. In this way, if the consecutive number n (the number of pages k) is greater than or equal to the threshold th, wear of the photosensitive drum 134*y* and the like progresses because single-color images are formed in the multicolor mode. Accordingly, by performing switching from the multicolor mode to the single-color mode, the life span of the photosensitive drum 134*y* and the like is extended. Meanwhile, if the consecutive number n (the number of pages k) is less than the threshold th, wear of the photosensitive drum 134*y* does not progress that much. Accordingly, switching from the multicolor mode to the single-color mode may be skipped.

As explained by using FIG. 1, the image forming unit 132*k* is a black station for forming an image by using black toner. An image forming unit 132*y* is a yellow station for forming an image by using yellow toner. An image forming unit 132*m* is a magenta station for forming an image by using magenta toner. An image forming unit 132*c* is a cyan station for forming an image by using cyan toner. The intermediate transfer belt 131 is an intermediate transfer member onto which an image of at least one of the black station, the yellow station, the magenta station, and the cyan station is transferred. The multicolor mode is a color mode in which the intermediate transfer belt 131 is caused to be in contact with the black station, the yellow station, the magenta station, and the cyan station. The single-color mode is a mode in which the intermediate transfer belt 131 is caused to separate from the yellow station, the magenta station, and the cyan station while the intermediate transfer belt 131 is caused to be in contact with only the black station. The CPU 300 controls the black station, the yellow station, the magenta station and the cyan station to form of a multicolor image that superimposes an image that uses black toner, an image that uses yellow toner, an image that uses magenta toner, and an image that uses cyan toner, or to form of a single-color image that only uses black toner. Toner of four colors are used in the embodiment described above, but the present invention can be applied to an image forming apparatus that uses toner of two or more colors.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-113800, filed Jun. 7, 2016 which is hereby incorporated by reference herein in its entirety.

What is claimed is:

1. An image forming apparatus, comprising:

a first forming unit configured to form an image by using toner of a first color;

a second forming unit configured to form an image by using toner of a second color;

an intermediate transfer member onto which at least the image from the first forming unit is transferred;

a contact and separation unit having a multicolor mode in which the contact and separation unit causes the intermediate transfer member to be in contact with both of the first forming unit and the second forming unit, and a single-color mode in which the contact and separation unit causes the intermediate transfer member to be separated from the second forming unit while causing the intermediate transfer member to stay in contact with the first forming unit; and a controller configured to control the first forming unit and the second forming unit to form a multicolor image that superimposes an image using the toner of the first color and an image using the toner of the second color, or form a single-color image that uses the toner of the first color and does not use the toner of the second color, wherein the controller is configured to, if switching from the single-color mode to the multicolor mode is necessary in an inputted job, switch from the single-color mode to the multicolor mode during a relatively long processing waiting time out of processing waiting times between preceding pages and succeeding pages, before a page in the job for forming the multicolor image, and wherein the controller is configured to, if there is a page onto which the single-color image is to be formed before the page onto which the multicolor image is to be formed after switching from the single-color mode to the multicolor mode, use the multicolor mode to form the single-color image.

2. The image forming apparatus according to claim 1, wherein the controller includes:

a decision function configured to analyze the job and decide processing waiting times between the pages, and a specifying function configured to specify the relatively long processing waiting time based on the processing waiting times between the pages decided by the decision function.

3. The image forming apparatus according to claim 1, wherein the controller is configured to, if an i-th page in the job is a page onto which a multicolor image is to be formed, each of an i−j−th to an i−1-th page is a page onto which a single-color image is to be formed, and a processing waiting time between an i−j−1-th page and the i−j-th page is relatively longer than a processing waiting time between the i−1-th page and the i-th page, perform switching from the single-color mode to the multicolor mode during the processing waiting time between the i−j−1-th page and the i−j-th page.

4. The image forming apparatus according to claim 3, wherein the controller is configured to prohibit switching from the multicolor mode to the single-color mode during processing waiting times present from the i−j-th page to the i-th page.

5. The image forming apparatus according to claim 3, wherein the controller includes:

an obtaining function configured to obtain a number of pages j from the i−j-th page to the i−1-th page, and a determination function configured to determine whether the number of pages j is less than or equal to a threshold, and wherein the controller is configured to:

if the number of pages j is less than or equal to the threshold, perform switching from the single-color mode to the multicolor mode during a processing waiting time between the i−j−1-th page and the i−j-th page, and if the number of pages j is not less than or equal to the threshold, perform switching from the single-color mode to the multicolor mode during a processing waiting time between the i−1-th page and the i-th page.

6. The image forming apparatus according to claim 1, wherein the first forming unit is an image forming unit for forming an image by using black toner, and the second forming unit is an image forming unit for forming an image by using yellow, magenta, and cyan toner.

7. The image forming apparatus according to claim 1, wherein the contact and separation unit is further configured to cause the intermediate transfer member to contact with or separate from an image carrier of the second forming unit.

8. An image forming apparatus, comprising:

a first forming unit configured to form an image by using toner of a first color;

a second forming unit configured to form an image by using toner of a second color;

an intermediate transfer member onto which at least the image from the first forming unit is transferred;

a contact and separation unit having a multicolor mode in which the contact and separation unit causes the intermediate transfer member to be in contact with both of the first forming unit and the second forming unit, and a single-color mode in which the contact and separation unit causes the intermediate transfer member to be separated from the second forming unit while causing the intermediate transfer member to stay in contact with the first forming unit; and a controller configured to control the first forming unit and the second forming unit to form a multicolor image that superimposes an image using the toner of the first color and an image using the toner of the second color, or form a single-color image that uses the toner of the first color and does not use the toner of the second color, wherein the controller is configured to, if switching from the single-color mode to the multicolor mode is necessary in an inputted job, switch from the single-color mode to the multicolor mode during a relatively long processing waiting time out of processing waiting times between preceding pages and succeeding pages, before a page in the job for forming the multicolor image, the relatively long processing waiting time being a processing waiting time allocated for forming images on both sides of a sheet.

9. An image forming apparatus, comprising:

a first forming unit configured to form an image by using toner of a first color;

a second forming unit configured to form an image by using toner of a second color;

an intermediate transfer member onto which at least the image from the first forming unit is transferred;

a contact and separation unit having a multicolor mode in which the contact and separation unit causes the intermediate transfer member to be in contact with both of the first forming unit and the second forming unit, and a single-color mode in which the contact and separation unit causes the intermediate transfer member to be separated from the second forming unit while causing the intermediate transfer member to stay in contact with the first forming unit;

a fixing unit configured to fix an image transferred from the intermediate transfer member to a sheet; and a controller configured to control the first forming unit and the second forming unit to form a multicolor image that superimposes an image using the toner of the first color and an image using the toner of the second color, or form a single-color image that uses the toner of the first color and does not use the toner of the second color, wherein the controller is configured to, if switching from the single-color mode to the multicolor mode is necessary in an inputted job, switch from the single-color mode to the multicolor mode during a relatively long processing waiting time out of processing waiting times between preceding pages and succeeding pages, before a page in the job for forming the multicolor image, the relatively long processing waiting time being a processing waiting time allocated to reduce a rise in temperature of a part of the fixing unit.

10. An image forming apparatus, comprising:

a first forming unit configured to form an image by using toner of a first color;

a second forming unit configured to form an image by using toner of a second color;

an intermediate transfer member onto which at least the image from the first forming unit is transferred;

a contact and separation unit having a multicolor mode in which the contact and separation unit causes the intermediate transfer member to be in contact with both of the first forming unit and the second forming unit, and a single-color mode in which the contact and separation unit causes the intermediate transfer member to be separated from the second forming unit while causing the intermediate transfer member to stay in contact with the first forming unit; and a controller configured to control the first forming unit and the second forming unit to form a multicolor image that superimposes an image using the toner of the first color and an image using the toner of the second color, or form a single-color image that uses the toner of the first color and does not use the toner of the second color, wherein the controller is configured to, if switching from the single-color mode to the multicolor mode is necessary in an inputted job, switch from the single-color mode to the multicolor mode during a relatively long processing waiting time out of processing waiting times between preceding pages and succeeding pages, before a page in the job for forming the multicolor image, the relatively long processing waiting time being a processing waiting time allocated to perform correction processing for correcting shifting of image formation positions.

11. An image forming apparatus, comprising:

a first forming unit configured to form an image by using toner of a first color;

a second forming unit configured to form an image by using toner of a second color;

an intermediate transfer member onto which at least the image from the first forming unit is transferred;

a contact and separation unit having a multicolor mode in which the contact and separation unit causes the intermediate transfer member to be in contact with both of the first forming unit and the second forming unit, and a single-color mode in which the contact and separation unit causes the intermediate transfer member to be separated from the second forming unit while causing the intermediate transfer member to stay in contact with the first forming unit; and a controller configured to control the first forming unit and the second forming unit to form a multicolor image that superimposes an image using the toner of the first color and an image using the toner of the second color, or form a single-color image that uses the toner of the first color and does not use the toner of the second color, wherein the controller is configured to, if switching from the single-color mode to the multicolor mode is necessary in an inputted job, switch from the single-color mode to the multicolor mode during a relatively long processing waiting time out of processing waiting times between preceding pages and succeeding pages, before a page in the job for forming the multicolor image, the relatively long processing waiting time being a processing waiting time allocated to perform correction processing for correcting image density.

12. An image forming apparatus, comprising:

a first forming unit configured to form an image by using toner of a first color;

a second forming unit configured to form an image by using toner of a second color;

an intermediate transfer member onto which at least the image from the first forming unit is transferred;

a contact and separation unit having a multicolor mode in which the contact and separation unit causes the intermediate transfer member to be in contact with both of the first forming unit and the second forming unit, and a single-color mode in which the contact and separation unit causes the intermediate transfer member to be separated from the second forming unit while causing the intermediate transfer member to stay in contact with the first forming unit; and a controller configured to control the first forming unit and the second forming unit to form a multicolor image that superimposes an image using the toner of the first color and an image using the toner of the second color, or form a single-color image that uses the toner of the first color and does not use the toner of the second color, wherein the controller, if switching from the multicolor mode to the single-color mode in an inputted job, switches from the multicolor mode to the single-color mode during a relatively long processing waiting time out of processing waiting times between preceding pages and succeeding pages in the job, and wherein the controller is configured to, if an i-th page in the job is a page onto which a multicolor image is to be formed, each of an i+1-th page to an i+k-th page is a page onto which a single-color image is to be formed, and a processing waiting time between an i+k−1-th page and the i+k-th page is relatively longer than a processing waiting time between the i-th page and the i+1-th page, perform switching from the multicolor mode to the single-color mode during the processing waiting time between the i+k−1-th page and the i+k-th page.

13. The image forming apparatus according to claim 12, wherein the controller includes:

a decision function configured to analyze the job and decide processing waiting times between the pages, and a specifying function configured to specify the relatively long processing waiting time based on the processing waiting times between the pages decided by the decision function.

14. The image forming apparatus according to claim 12, wherein the controller is configured to prohibit switching from the multicolor mode to the single-color mode during processing waiting times present from the i+1-th page to the i+k−1-th page.

15. The image forming apparatus according to claim 12, wherein the controller includes:

an obtaining function configured to obtain a number of pages k from the i+l-th page to the i+k-th page, and a determination function configured to determine whether the number of pages k is greater than or equal to a threshold, and is configured to:

perform switching from the multicolor mode to the single-color mode during a processing waiting time between the i+k−1-th page and the i+k-th page when the number of pages k is greater than or equal to the threshold, and when the number of pages k is not greater than or equal to the threshold, not perform switching from the multicolor mode to the single-color mode during a processing waiting time between the i-th page and the i+1-th page.

16. The image forming apparatus according to claim 12, wherein the first forming unit is an image forming unit for forming an image by using black toner, and the second forming unit is an image forming unit for forming an image by using yellow, magenta, and cyan toner.

17. The image forming apparatus according to claim 12, wherein the contact and separation unit is further configured to cause the intermediate transfer member to contact with or separate from an image carrier of the second forming unit.

18. An image forming apparatus, comprising:

a first forming unit configured to form an image by using toner of a first color;

a second forming unit configured to form an image by using toner of a second color;

an intermediate transfer member onto which at least the image from the first forming unit is transferred;

a contact and separation unit having a multicolor mode in which the contact and separation unit causes the intermediate transfer member to be in contact with both of the first forming unit and the second forming unit, and a single-color mode in which the contact and separation unit causes the intermediate transfer member to be separated from the second forming unit while causing the intermediate transfer member to stay in contact with the first forming unit; and a controller configured to control the first forming unit and the second forming unit to form a multicolor image that superimposes an image using the toner of the first color and an image using the toner of the second color, or form a single-color image that uses the toner of the first color and does not use the toner of the second color, wherein the controller, if switching from the multicolor mode to the single-color mode in an inputted job, switches from the multicolor mode to the single-color mode during a relatively long processing waiting time out of processing waiting times between preceding pages and succeeding pages in the job, the relatively long processing waiting time being a processing waiting time allocated for forming images on both sides of a sheet.

19. An image forming apparatus, comprising:

a first forming unit configured to form an image by using toner of a first color;

a second forming unit configured to form an image by using toner of a second color;

an intermediate transfer member onto which at least the image from the first forming unit is transferred;

a contact and separation unit having a multicolor mode in which the contact and separation unit causes the intermediate transfer member to be in contact with both of the first forming unit and the second forming unit, and a single-color mode in which the contact and separation unit causes the intermediate transfer member to be separated from the second forming unit while causing the intermediate transfer member to stay in contact with the first forming unit;

a fixing unit for fixing an image transferred from the intermediate transfer member to a sheet; and a controller configured to control the first forming unit and the second forming unit to form a multicolor image that superimposes an image using the toner of the first color and an image using the toner of the second color, or form a single-color image that uses the toner of the first color and does not use the toner of the second color, wherein the controller, if switching from the multicolor mode to the single-color mode in an inputted job, switches from the multicolor mode to the single-color mode during a relatively long processing waiting time out of processing waiting times between preceding pages and succeeding pages in the job, the relatively long processing waiting time being a processing waiting time allocated to reduce a rise in temperature of a part of the fixing unit.

20. An image forming apparatus, comprising:

a first forming unit configured to form an image by using toner of a first color;

a second forming unit configured to form an image by using toner of a second color;

an intermediate transfer member onto which at least the image from the first forming unit is transferred;

a contact and separation unit having a multicolor mode in which the contact and separation unit causes the intermediate transfer member to be in contact with both of the first forming unit and the second forming unit, and a single-color mode in which the contact and separation unit causes the intermediate transfer member to be separated from the second forming unit while causing the intermediate transfer member to stay in contact with the first forming unit; and a controller configured to control the first forming unit and the second forming unit to form a multicolor image that superimposes an image using the toner of the first color and an image using the toner of the second color, or form a single-color image that uses the toner of the first color and does not use the toner of the second color, wherein the controller, if switching from the multicolor mode to the single-color mode in an inputted job, switches from the multicolor mode to the single-color mode during a relatively long processing waiting time out of processing waiting times between preceding pages and succeeding pages in the job, the relatively long processing waiting time being a processing waiting time allocated to perform correction processing for correcting shifting of image formation positions.

21. An image forming apparatus, comprising:

a first forming unit configured to form an image by using toner of a first color;

a second forming unit configured to form an image by using toner of a second color;

an intermediate transfer member onto which at least the image from the first forming unit is transferred;

a contact and separation unit having a multicolor mode in which the contact and separation unit causes the intermediate transfer member to be in contact with both of the first forming unit and the second forming unit, and a single-color mode in which the contact and separation unit causes the intermediate transfer member to be separated from the second forming unit while causing the intermediate transfer member to stay in contact with the first forming unit; and a controller configured to control the first forming unit and the second forming unit to form a multicolor image that superimposes an image using the toner of the first color and an image using the toner of the second color, or form a single-color image that uses the toner of the first color and does not use the toner of the second color, wherein the controller, if switching from the multicolor mode to the single-color mode in an inputted job, switches from the multicolor mode to the single-color mode during a relatively long processing waiting time out of processing waiting times between preceding pages and succeeding pages in the job, the relatively long processing waiting time being a processing waiting time allocated to perform correction processing for correcting image density.

22. A method in an image forming apparatus, the method comprising:

receiving a job in which a plurality of single-color images are to be formed before a multicolor image;

searching for a relatively long processing waiting time out of processing waiting times that occur between adjacent images of the plurality of single-color images and the multicolor image that is subsequent to the plurality of single-color images;

forming, in order, some single-color images included in the plurality of single-color images in a single-color mode until the relatively long processing waiting time;

switching from the single-color mode to a multicolor mode during the relatively long processing waiting time; and forming, in order, remaining single-color images included in the plurality of single-color images and the multicolor image in the multicolor mode after the relatively long processing waiting time, wherein the forming, in order, of some single-color images included in the plurality of single-color images in the single-color mode until the relatively long processing waiting time comprises if there is a page onto which the single-color image is to be formed before the page onto which the multicolor image is to be formed after switching from the single-color mode to the multicolor mode, using the multicolor mode to form the single-color image.

23. A method in an image forming apparatus, the method comprising:

receiving a job in which a plurality of single-color images are to be formed after a multicolor image;

searching for a relatively long processing waiting time out of processing waiting times that occur between adjacent images of the plurality of single-color images and the multicolor image that is to be formed first;

forming, in order, some single-color images that are included in the plurality of single-color images and the multicolor image in a multicolor mode until the relatively long processing waiting time arrives;

switching from the multicolor mode to a single-color mode during the relatively long processing waiting time; and forming, in order, remaining single-color images included in the plurality of single-color images in the single-color mode after the relatively long processing waiting time, wherein the switching from the multicolor mode to the single-color mode during the relatively long processing waiting time comprises, if an i-th page in the job is a page onto which a multicolor image is to be formed, each of an i+1-th page to an i+k-th page is a page onto which a single-color image is to be formed, and a processing waiting time between an i+k−1-th page and the i+k-th page is relatively longer than a processing waiting time between the i-th page and the i+1-th page, switching from the multicolor mode to the single-color mode during the processing waiting time between the i+k−1-th page and the i+k-th page.

* * * * *